US010602852B2

(12) United States Patent
Choi

(10) Patent No.: US 10,602,852 B2
(45) Date of Patent: Mar. 31, 2020

(54) FOLDABLE BED FRAMES AND SUPPORTS AND CONNECTING MECHANISMS FOR FOLDABLE BED FRAMES

(71) Applicant: Inno-Sports Co., Ltd., Xiamen (CN)

(72) Inventor: Kwanjun Choi, Xiamen (CN)

(73) Assignee: Inno-Sports Co., LTD., Xiamen (CN)

( * ) Notice: Subject to any disclaimer, the term of this patent is extended or adjusted under 35 U.S.C. 154(b) by 849 days.

(21) Appl. No.: 15/144,597

(22) Filed: May 2, 2016

(65) Prior Publication Data

US 2016/0316923 A1 Nov. 3, 2016

(30) Foreign Application Priority Data

| | | |
|---|---|---|
| Apr. 30, 2015 | (CN) | 2015 2 0274053 U |
| Apr. 30, 2015 | (CN) | 2015 2 0274062 U |
| Apr. 30, 2015 | (CN) | 2015 2 0274176 U |
| Apr. 30, 2015 | (CN) | 2015 2 0274200 U |
| Aug. 19, 2015 | (CN) | 2015 2 0626106 U |
| Jan. 15, 2016 | (CN) | 2016 2 0037623 U |
| Jan. 15, 2016 | (CN) | 2016 2 0037628 U |
| Jan. 15, 2016 | (CN) | 2016 2 0037640 U |

(51) Int. Cl.
*A47C 19/12* (2006.01)
*A47C 19/02* (2006.01)

(52) U.S. Cl.
CPC ..... *A47C 19/122* (2013.01); *A47C 19/024* (2013.01); *A47C 19/025* (2013.01)

(58) Field of Classification Search
CPC .... A47C 19/122; A47C 19/024; A47C 19/025
See application file for complete search history.

(56) References Cited

U.S. PATENT DOCUMENTS

| | | | | |
|---|---|---|---|---|
| 202,685 | A * | 4/1878 | White | A47C 19/122 5/111 |
| 324,843 | A * | 8/1885 | Horton | A47C 19/122 5/111 |
| 337,415 | A * | 3/1886 | McKeough | A47C 19/122 5/111 |
| 893,364 | A | 7/1908 | Piaser | |
| 1,196,253 | A | 8/1916 | Lowy | |
| 3,188,138 | A | 6/1965 | Lockshin | |
| 4,773,108 | A | 9/1988 | Leever | |

(Continued)

FOREIGN PATENT DOCUMENTS

| | | |
|---|---|---|
| CN | 204336376 U | 5/2015 |
| CN | 204336377 U | 5/2015 |
| GB | 810195 A | 3/1959 |

*Primary Examiner* — Eric J Kurilla
(74) *Attorney, Agent, or Firm* — Morgan, Lewis & Bockius LLP

(57) ABSTRACT

Disclosed are foldable bed frames, and oblique supports and connecting mechanisms for foldable bed frames. A foldable bed frame includes first and second sub-frames, and first and second side leg assemblies. The first and second sub-frames, each having top and bottom surfaces, are pivotally connected to each other. The first and second side leg assemblies are pivotally connected to the sub-frames and positioned within the space between the top and bottom surfaces of the sub-frames when folded. In some cases, the foldable bed frame includes a middle leg assembly, oblique supports, connecting pieces, and/or support connecting mechanisms.

38 Claims, 22 Drawing Sheets

(56) References Cited

U.S. PATENT DOCUMENTS

| | | | | |
|---|---|---|---|---|
| 5,331,725 | A | 7/1994 | Chou | |
| 6,062,589 | A | 5/2000 | Cheng | |
| 6,223,628 | B1 | 5/2001 | Barron | |
| 6,575,656 | B2 | 6/2003 | Suh | |
| 6,938,927 | B1 | 9/2005 | Martin | |
| 7,066,676 | B2 | 6/2006 | Tsai | |
| 7,144,078 | B2 | 12/2006 | Hsieh | |
| 7,849,867 | B2 | 12/2010 | Takayama | |
| 7,874,303 | B2 | 1/2011 | Xie | |
| 8,707,478 | B2 | 4/2014 | Jin | |
| 8,806,677 | B1 | 8/2014 | Bartelsmeyer | |
| 8,856,984 | B1 | 10/2014 | Donham | |
| 8,888,123 | B1 | 11/2014 | Cheng | |
| 9,027,952 | B2 | 5/2015 | Zhu | |
| 9,107,509 | B2 | 8/2015 | Lee | |
| 9,248,072 | B2 | 2/2016 | Wu | |
| 9,254,046 | B1 | 2/2016 | Arenstein | |
| 9,314,386 | B1 | 4/2016 | Boyd | |
| 9,456,698 | B2 | 10/2016 | Oh | |
| 9,895,003 | B2 | 2/2018 | Choi | |
| 9,907,405 | B2 | 3/2018 | An | |
| 10,021,986 | B1 | 7/2018 | Lin | |
| 10,123,629 | B2 | 11/2018 | Choi | |
| 10,125,801 | B2 | 11/2018 | Wilson | |
| 10,285,506 | B2 | 5/2019 | Choi | |
| 2006/0062632 | A1 | 3/2006 | Jang | |
| 2007/0012346 | A1 | 1/2007 | Choi | |
| 2009/0133191 | A1 | 5/2009 | Harrow | |
| 2010/0176634 | A1 | 7/2010 | Wahl | |
| 2010/0299831 | A1 | 12/2010 | Lee | |
| 2011/0099712 | A1 | 5/2011 | Jin | |
| 2012/0222216 | A1 | 9/2012 | Jin | |
| 2013/0067659 | A1 | 3/2013 | Oh | |
| 2013/0276228 | A1 | 10/2013 | Hsieh | |
| 2015/0143630 | A1 | 5/2015 | Harrow | |
| 2015/0320225 | A1 | 11/2015 | Boyd | |
| 2015/0327684 | A1* | 11/2015 | Lee | A47C 19/025 5/200.1 |
| 2016/0157620 | A1 | 6/2016 | Oh | |
| 2017/0122353 | A1 | 5/2017 | Halliburton | |
| 2018/0110339 | A1* | 4/2018 | Moon | A47C 19/025 |
| 2018/0192778 | A1* | 7/2018 | Choi | A47C 19/027 |
| 2018/0271296 | A1* | 9/2018 | Harrow | A47C 19/022 |
| 2018/0332973 | A1* | 11/2018 | Choi | A47C 19/12 |
| 2019/0029435 | A1* | 1/2019 | Choi | A47C 19/024 |
| 2019/0045938 | A1* | 2/2019 | Skaggs | A47C 19/025 |

* cited by examiner

FOLDABLE BED FRAMES AND SUPPORTS AND CONNECTING MECHANISMS FOR FOLDABLE BED FRAMES

CROSS-REFERENCE TO RELATED APPLICATIONS

The present application claims priority to Chinese Utility Model Applications: CN201520274053.2, filed Apr. 30, 2015; CN201520274062.1, filed Apr. 30, 2015; CN201520274176.6, filed Apr. 30, 2015; CN201520274200.6, filed Apr. 30, 2015; CN201520626106.2, filed Aug. 19, 2015; CN201620037623.0, filed Jan. 15, 2016; CN201620037628.3, filed Jan. 15, 2016; and CN201620037640.4, filed Jan. 15, 2016. The disclosure of each of these applications is incorporated herein for all purposes by reference.

FIELD OF THE INVENTION

The present invention generally relates to foldable bed frames and components for foldable bed frames. More particularly, the present invention relates to foldable bed frames having pivotally connected sub-frames and leg assemblies, oblique supports and connecting mechanisms for foldable bed frames.

BACKGROUND

Generally, a foldable bed frame includes two pivotally connected sub-frames, and legs pivotally connected to and supporting the sub-frames. To stabilize the foldable bed frame, legs are usually connected to each other by lateral bars, and lateral bars are connected to sub-frames by oblique supports. One example of such a foldable bed frame is disclosed in CN 204336377 U, the disclosure of which is incorporated herein for all purposes by reference. Another example is disclosed in CN 204336376 U, the disclosure of which is incorporated herein for all purposes by reference.

A typical foldable bed frame, when folded, often has a thickness equal to the sum of the thicknesses of the sub-frames and the legs. As such, it requires large packaging containers and storage spaces, which are inconvenient for shipping, transportation and daily use. The size of the bed frame and the amount of material used in its manufacture also increases the cost of the bed frame.

Oblique supports in a typical existing foldable bed frame in general are coupled to the lateral bars and the sub-frames without releasing or unlocking mechanisms. Decoupling such oblique supports is accomplished by pushing the oblique supports sideways, as shown in FIGS. 17A and 17B. In some cases, oblique supports are short bars or struts directly fastened to the lateral bars and the sub-frames. Such oblique supports exert forces on fasteners, loosening the fasteners and consequently result in a foldable bed frame, which is unstable.

Given the current state of the art, there remains a need for foldable bed frames and component parts of these bed frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides foldable bed frames that are stable, compact, and convenient for packing, shipping and transportation. The present invention also provides oblique supports and connecting mechanisms for foldable bed frames.

In some embodiments, the present invention provides a foldable bed frame including first and second sub-frames, and first and second side leg assemblies. First and second sub-frames are pivotally connected to each other at their proximal sides, and each sub-frame has a top surface and a bottom surface. First and second side leg assemblies correspond to the first and second sub-frames. For each sub-frame, the side leg assembly is disposed at a distal side of the sub-frame, pivotally connected to the sub-frame, positioned within a space between the top surface and the bottom surface of the sub-frame when folded, and supports the sub-frame when unfolded.

In some embodiments, the foldable bed frame further includes a plurality of leg connecting pieces for pivotally connecting the side leg assemblies to the sub-frames. In an exemplary embodiment, each sub-frame includes a peripheral frame having left and right longitudinal peripheral bars. Each sub-frame also includes left and right interior longitudinal bars disposed within the peripheral frame and substantially parallel to the left and right longitudinal peripheral bars, respectively. Each respective leg connecting piece is disposed between corresponding longitudinal peripheral and interior bars. The leg connecting piece is pivotally connected to the corresponding longitudinal peripheral and interior bars, and fixedly connected to a corresponding side leg assembly. In an embodiment, the leg connecting piece includes a protrusion disposed in a leg of the side leg assembly. In an embodiment, the foldable bed frame further includes a plurality of leg limiting pieces. Each leg limiting piece corresponds to a leg connecting piece and rotates along with the corresponding leg connecting piece.

In some embodiments, the foldable bed frame further includes a plurality of oblique supports, each having a first end connected to a corresponding sub-frame, and a second end connected to a corresponding side leg assembly. In some embodiments, each side leg assembly includes left and right legs, and a leg lateral bar connecting the left and right legs.

In some embodiments, the foldable bed frame further includes a middle leg assembly disposed between the first and second sub-frames, and pivotally connected to the first and second sub-frames. In an embodiment, the middle leg assembly includes left and right middle legs, and the foldable bed frame further includes left and right frame connecting pieces, with each frame connecting piece is pivotally connected to a corresponding middle leg, and corresponding ends of the first and second sub-frames.

In some embodiments, the present invention provides a foldable bed frame including first and second sub-frames, a middle leg assembly, and left and right frame connecting pieces. Each of the first and second sub-frames includes two ends at its proximal side, and a lower side of each end is formed with a recess. The middle leg assembly is disposed between the first and second sub-frames, and includes left and right middle legs. Each of the left and right frame connecting pieces is pivotally connected to a corresponding middle leg, and includes a supporting segment and at least one connecting segment. The supporting segment is formed at a lower portion of each frame connecting piece. The connecting segment includes a first side pivotally connected to a corresponding end of the first sub-frame, and a second side pivotally connected to a corresponding end of the second sub-frame. When the foldable bed frame is folded, two ends of the supporting segments are positioned in the recesses formed at the lower sides of the corresponding ends of the first and second sub-frames, thereby minimizing a thickness of the foldable bed frame.

In some embodiments, the foldable bed frame further includes first and second side leg assemblies corresponding to the first and second sub-frames, with each side leg assembly disposed at a distal side of the corresponding sub-frame and pivotally connected to the sub-frame. In some embodiments, the foldable bed frame further includes a plurality of oblique supports, each having a first end connected to a corresponding sub-frame, and a second end connected to a corresponding side leg assembly.

In an exemplary embodiment, each frame connecting piece includes two connecting segments substantially parallel to each other and connected to each other by the supporting segment. In various embodiments, the connecting segment and the supporting segment of each frame connecting piece are monolithically or integrally formed as one piece.

In some embodiments, each sub-frame includes a bent bar with two ends, and two bar connecting pieces. Each bar connecting piece includes one or more first segments and a second segment. The one or more first segments are fixedly connected to a corresponding end of the bent bar. The second segment is pivotally connected to the corresponding frame connecting piece. The recess is formed at a lower side of the second segment of the bar connecting piece. In an embodiment, each bar connecting piece includes two first segments, with the corresponding end of the bent bar disposed in between the two first segments and fixedly coupled to the two first segments. In an exemplary embodiment, the first and second segments of each bar connecting piece are monolithically or integrally formed as one piece. In an embodiment, the bent bar has substantially an "⊏" shape.

In some embodiments, the present invention provides a foldable bed frame including first and second sub-frames, first and second side leg assemblies, and a plurality of oblique supports. The first and second sub-frames are pivotally connected to each other at their proximal sides. The first and second side leg assemblies correspond to the first and second sub-frames. For each sub-frame, the side leg assembly is disposed at a distal side of the sub-frame, pivotally connected to the sub-frame, and supports the sub-frame when unfolded.

Each oblique support has a first end connected to a corresponding sub-frame, and a second end connected to a corresponding side leg assembly.

In some embodiments, the foldable frame further includes a middle leg assembly disposed between the first and second sub-frames, and pivotally connected to both of the first and second sub-frames at their proximal sides.

In some embodiments, corresponding to each of the first and second sub-frames, the side leg assembly includes a left leg pivotally connected to a left side of the sub-frame, a right leg pivotally connected to a right side of the sub-frame, and a leg lateral bar connecting the left and right legs. The first end of a corresponding oblique support is connected to the left leg, the right leg or the lateral bar of the side leg assembly. The second end of the corresponding oblique support is connected to a frame lateral bar of the sub-frame. In an embodiment, the frame lateral bar is a peripheral lateral bar disposed at the proximal side of the sub-frame. In another embodiment, the frame lateral bar is an interior lateral bar of the sub-frame.

In an embodiment, each of the first and second ends of an oblique support is formed with an assembly hole for coupling with the sub-frame and the side leg assembly. In an embodiment, the first or second end of an oblique support is formed with an open slot for releasably or adjustably coupling with the sub-frame or the side leg assembly. In an embodiment, corresponding to an oblique support, the side leg assembly further includes a first connecting piece fixedly disposed at the left leg, the right leg or the leg lateral bar. The first connecting piece is formed with an assembly hole or an opening slot for coupling with the first end of the oblique support. In an embodiment, corresponding to an oblique support, the sub-frame further includes a second connecting piece fixedly disposed at the frame lateral bar. The second connecting piece is formed with an assembly hole or an opening slot for coupling with the second end of the oblique support.

In some embodiments, the first end of an oblique support in the plurality of oblique supports is fixedly or pivotally connected to the leg lateral bar of the side leg assembly. The second end of the oblique support is releasably locked with the frame lateral bar of the sub-frame. In some embodiments, the second end of the oblique support is releasably locked with the sub-frame by one of the following: (i) the sub-frame is formed with an assembly hole, and the second end of the oblique support is formed with an opening slot corresponding to the assembly hole of the sub-frame, wherein the assembly hole of the sub-frame and the opening slot of the oblique support are coupled to each other by a fastener; (ii) the sub-frame includes a connecting piece corresponding to the second end of the oblique support and formed with an assembly hole, and the second end of the oblique support is formed with an opening slot, wherein the assembly hole of the connecting piece and the opening slot of the oblique support are coupled to each other by a fastener; and (iii) the sub-frame includes a connecting piece corresponding to the second end of the oblique support and formed with an opening slot, and the second end of the oblique support is formed with an assembly hole, wherein the opening slot of the connecting piece and the assembly hole of the oblique support are coupled to each other by a fastener. In an embodiment, the opening slot of the oblique support or the connecting piece has a "U" shape or a "C" shape.

In some embodiments, a foldable bed frame further including a plurality of support connecting mechanisms.

In some embodiments, the present invention provides a support connecting mechanism for a foldable bed frame. The foldable bed frame includes a sub-frame, a side leg assembly and an oblique support. The side leg assembly pivotally connected to the sub-frame. The oblique support has a first end pivotally connected to the side leg assembly and a second end formed with an assembly hole. The support connecting mechanism includes a second connecting piece, a third connecting piece, a fastener, and an elastic member. The second connecting piece is fixedly disposed at the frame lateral bar of a corresponding sub-frame, and formed with an assembly hole corresponding to the assembly hole formed at the second end of the oblique support. The third connecting piece is fixedly disposed at the frame lateral bar of the corresponding sub-frame, having substantially a "⊏" shape with two side segments and a middle segment connecting the two side segments. Each of the two side segments is formed with an assembly hole. The fastener is inserted into the assembly holes formed at the second end of the oblique support, at the second connecting piece and at the third connecting piece, thereby releasably coupling the oblique support with the sub-frame. The elastic member is disposed between the two side segments, and coupled to the fastener to restore the fastener in an initial position. In an embodiment where the fastener has a proximal end and a distal end with respect to the second connecting piece, the support connecting mechanism further includes a pull ring coupled to the distal end of the fastener. In an embodiment, the elastic member sleeves over the fastener, and has one end coupled to the fastener and the other end coupled to the third connecting piece. In an embodiment, the second and third connecting pieces are monolithically or integrally formed. In an embodiment, the third connecting piece is fixedly disposed at the frame lateral bar of the corresponding subframe, with an opening of the third connecting piece facing the frame lateral bar. In an embodiment, a proximal end of the fastener with respect to the second connecting piece is tapered or rounded to facilitate insertion of the fastener into the assembly holes formed at the second end of the oblique support, at the second connecting piece and at the third connecting piece.

In some embodiments, the present invention provides an oblique support including an inner tube, an outer tube, a locking mechanism, and an unlocking mechanism. The inner tube is formed with a first restriction hole. The outer tube is moveably coupled to the inner tube and is formed with a second restriction hole corresponding to the first restriction hole of the inner tube. The locking mechanism includes a positioning piece configured for insertion into the first and second restriction holes, thereby restricting the inner and outer tubes from moving with respect to each other. The unlocking mechanism disposed at the outer tube and configured to release the positioning piece from one or more of the first and second restriction holes, thereby allowing the inner and outer tunes to move with respect to each other. In an embodiment, the locking mechanism includes an elastic member disposed inside of the inner tube, and a protrusion disposed at or formed with the elastic member. The protrusion serves as the positioning piece and is configured to selectively protrude out of the first and second restriction holes. The unlocking mechanism includes a sliding block and a push button disposed at the sliding block. The push button includes a pillar corresponding to the protrusion of the locking mechanism. In an embodiment, the elastic member has substantially a "V" shape, with the protrusion disposed at an outer side of the elastic member and adjacent an opening of the elastic member. In an exemplary embodiment, the first restriction hole is formed at a distal end of the inner tube with respect to the outer tube. The second restriction hole is formed at a proximal end of the outer tube with respect to the inner tube. The sliding block includes an opening corresponding to the second restriction hole of the outer tube. The push button is coupled to the opening of the sliding block by one or more flanges formed on one or more sides of the push button and coupled with an inner side of the opening of the sliding block.

The bed frames and components for bed frames of the present invention have other features and advantages that will be apparent from or are set forth in more detail in the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Reference will now be made in detail to implementations of the exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the embodiments set forth in this disclosure can be made without departing from the spirit and scope of the embodiments, as will be apparent to those skilled in the art. The specific embodiments described herein are offered by way of example only.

Embodiments of the present invention are described in the context of foldable bed frames and components for foldable bed frames. The bed frames are of various sizes including but not limited to twin, full, queen and king sizes, and of various shapes including but not limited to rectangles and squares. Also, the bed frames can be made of various materials including but not limited to metals such as steel, plastics and woods.

Generally, a bed frame of the present invention includes a plurality of sub-frames such as first and second sub-frames 1 and a plurality of side leg assemblies such as first and second side leg assemblies 20. First and second sub-frames 1 are pivotally connected to each other at their proximal sides. First and second side leg assemblies 20 are disposed respectively at the dismal sides of first and second sub-frames 1, and pivotally connected to the corresponding sub-frame. The side leg assemblies support the sub-frames when the foldable bed frame is unfolded.

Figure 1A:
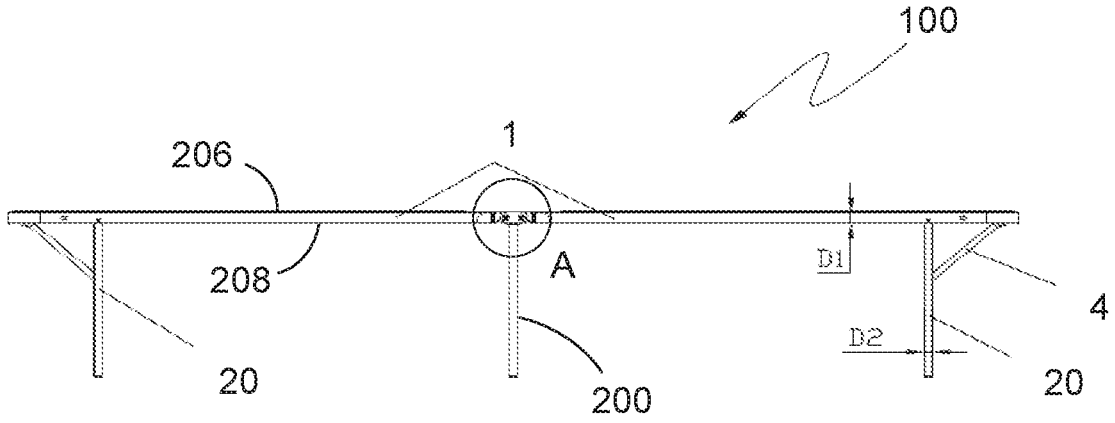
FIG. 1A is a schematic side view illustrating a foldable bed frame in an unfolded state with a first exemplary support in accordance with exemplary embodiments of the present invention.
Figure 1B:
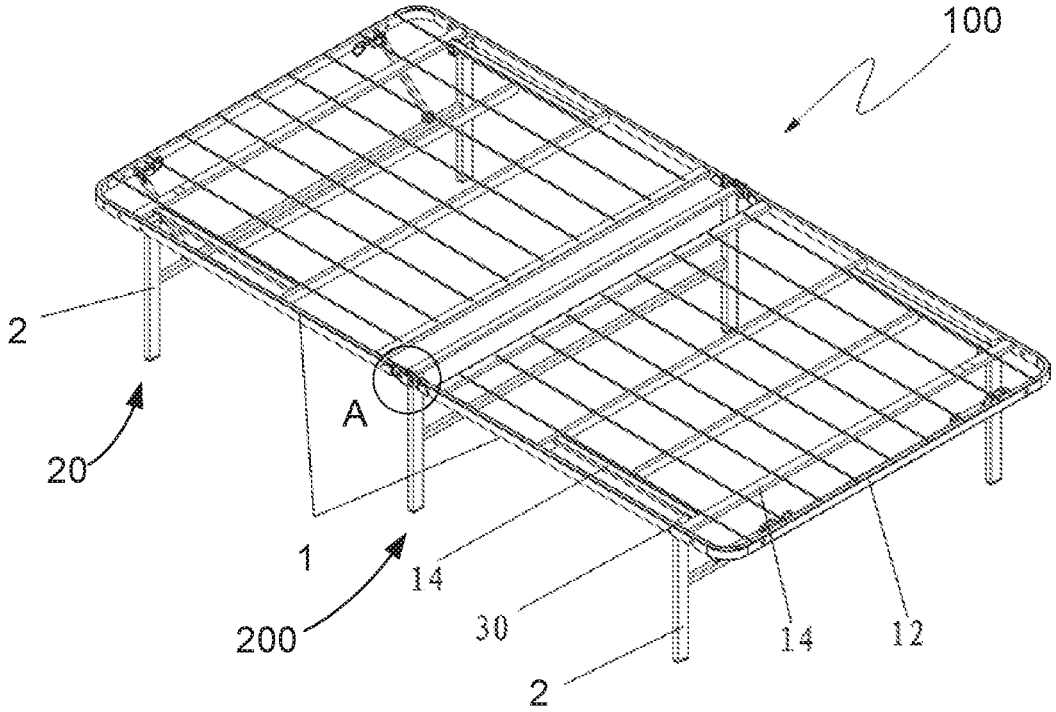
FIG. 1B is a schematic top perspective view illustrating the foldable bed frame of FIG. 1A.

As used herein, the sides at which first and second sub-frames 1 are connected to each other are referred to as their proximal sides, and the sides opposite the proximal sides are referred to as their distal sides. For instance, in FIGS. 1A and 1B, the proximal sides of first and second sub-frames are in the middle of the foldable bed frame. The distal sides correspond to head and foot sections of the bed frame. The other two sides are referred to as left and right sides. It should be noted that the term "middle" as used herein does not necessarily mean the center of the bed frame, and the term "side" does not necessarily mean an outmost edge of the bed frame.

In some embodiments, the bed frame of the present invention also includes a plurality of connecting pieces connecting two sub-frames or connecting one sub-frame with a side leg assembly. In some embodiments, the bed frame of the present invention also includes a middle leg assembly disposed between two sub-frames. In some embodiments, the bed frame of the present invention also includes a plurality of oblique supports each connected to a sub-frame and a side leg assembly.

Figure 1D:
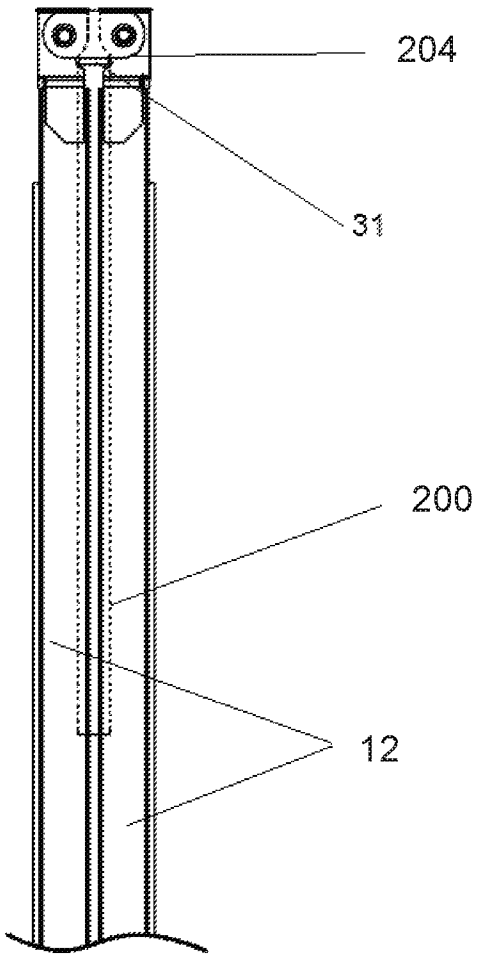
FIG. 1D is a schematic side view illustrating the foldable bed frame of FIG. 1A in a folded state.
Figure 1C:
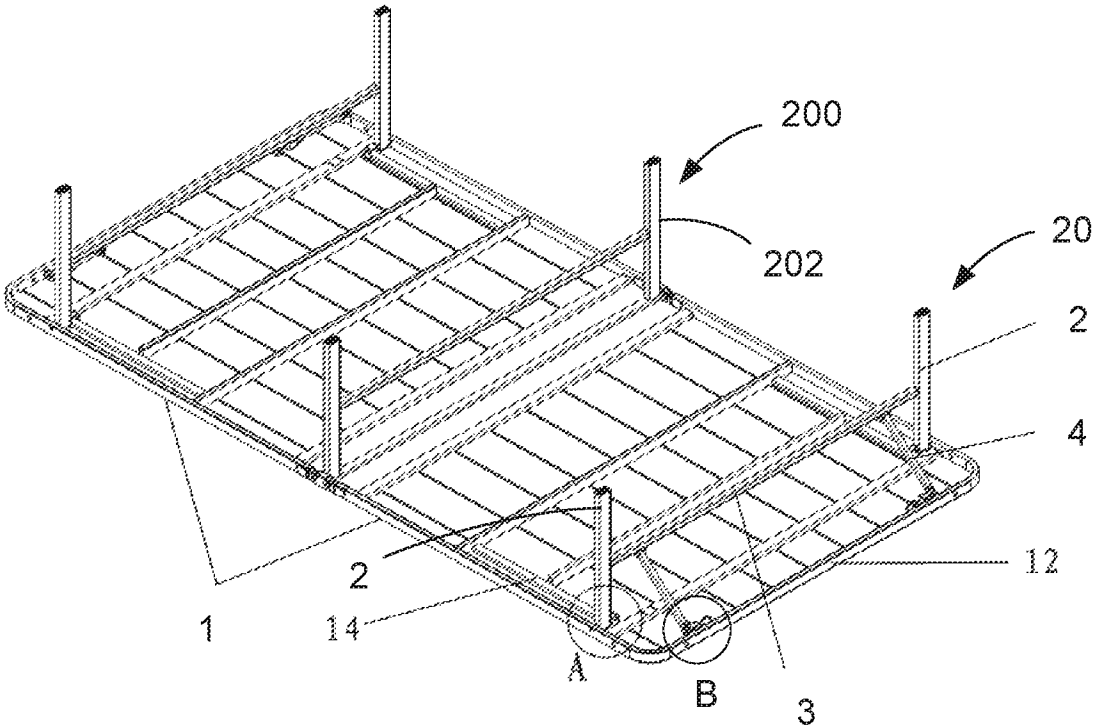
FIG. 1C is a schematic bottom perspective view illustrating the foldable bed frame of FIG. 1A.

Referring now to FIGS. 1A-1D, there is depicted an exemplary foldable bed frame 100 in accordance with various embodiments of the present invention. As shown, foldable bed frame 100 includes first and second sub-frames 1 pivotally connected to each other at their proximal sides, and first and second side leg assemblies 20 pivotally connected to first and second sub-frames 1. In some embodiments, each of first and second sub-frames 1 has a top surface such as top surface 206, a bottom surface such as bottom surface 208, and a thickness such as thickness D1 (e.g., the distance between the top and bottom surfaces). Each of first and second leg assemblies 20 has a width such as width D2. The sub-frames and the side leg assemblies are configured such that when a side leg assembly is folded to a corresponding sub-frame, the side leg assembly is positioned between the top and bottom surfaces of the corresponding sub-frame. In some embodiments, width D2 of a side leg assembly is less than thickness D1 of a corresponding sub-frame. In such embodiments, when the side leg assembly is folded to the corresponding sub-frame, the side leg assembly is confined within the top and bottom surfaces of the corresponding sub-frame; and when the bed frame is folded as illustrated in FIG. 1D, the overall thickness of the folded bed frame is the sum of the thicknesses of the sub-frames. As such, the folded bed frame of the present invention is compact, convenient for packing, shipping and transportation, and can be produced at reduced cost.

In some embodiments, foldable bed frame 100 further includes a plurality of leg connecting pieces for pivotally connecting the side leg assemblies to the sub-frames. For example, FIGS. 1C and 3A-3C illustrates connecting pieces 30 pivotally connecting side leg assemblies 20 to sub-frames 1. In the illustrated embodiment, each side leg assembly 20 includes left and right legs 2. Each sub-frame 1 includes a peripheral frame such as peripheral frame 12 and a plurality of interior bars such as interior bar 14 disposed within the peripheral frame. Peripheral frame 12 includes left and right longitudinal peripheral bars and a lateral peripheral bar connecting the left and right longitudinal peripheral bars. In an embodiment, the longitudinal and lateral peripheral bars of peripheral frame 12 is monolithically or integrally formed as one piece such as formed of a bent bar. The plurality of interior bars includes left and right interior longitudinal bars proximal to the left and right longitudinal peripheral bars, respectively, and substantially parallel to the left and right longitudinal peripheral bars. A leg connecting piece is disposed between a pair of the longitudinal peripheral and interior bars, and pivotally connected to the longitudinal peripheral and interior bars. In such embodiments, leg 2 of side leg assembly 20 is fixedly connected to the leg connecting piece.

In some embodiments, leg 2 (or a portion of leg 2) is hollow. In such embodiments, leg connecting piece 30 includes protrusion 35 in the middle and configured for insertion into the leg. Leg connecting piece 30 is formed with a through hole, from a first side of leg connecting piece 30 to a second side of leg connecting piece 30 and through protrusion 35. The leg is formed with a hole or hole(s) corresponding to the through hole of leg connecting piece 30. A fastener such as a bolt, a pin or a rivet, passes through the through hole of leg connecting piece 30 and the corresponding hole(s) of the leg, and is fixedly coupled to the longitudinal peripheral and interior bars of sub-frame 1. As such, leg 2 is fixedly coupled to leg connecting piece 30, and thus, leg 2 and leg connecting piece 30 can rotate together without slipping.

Figure 3A:
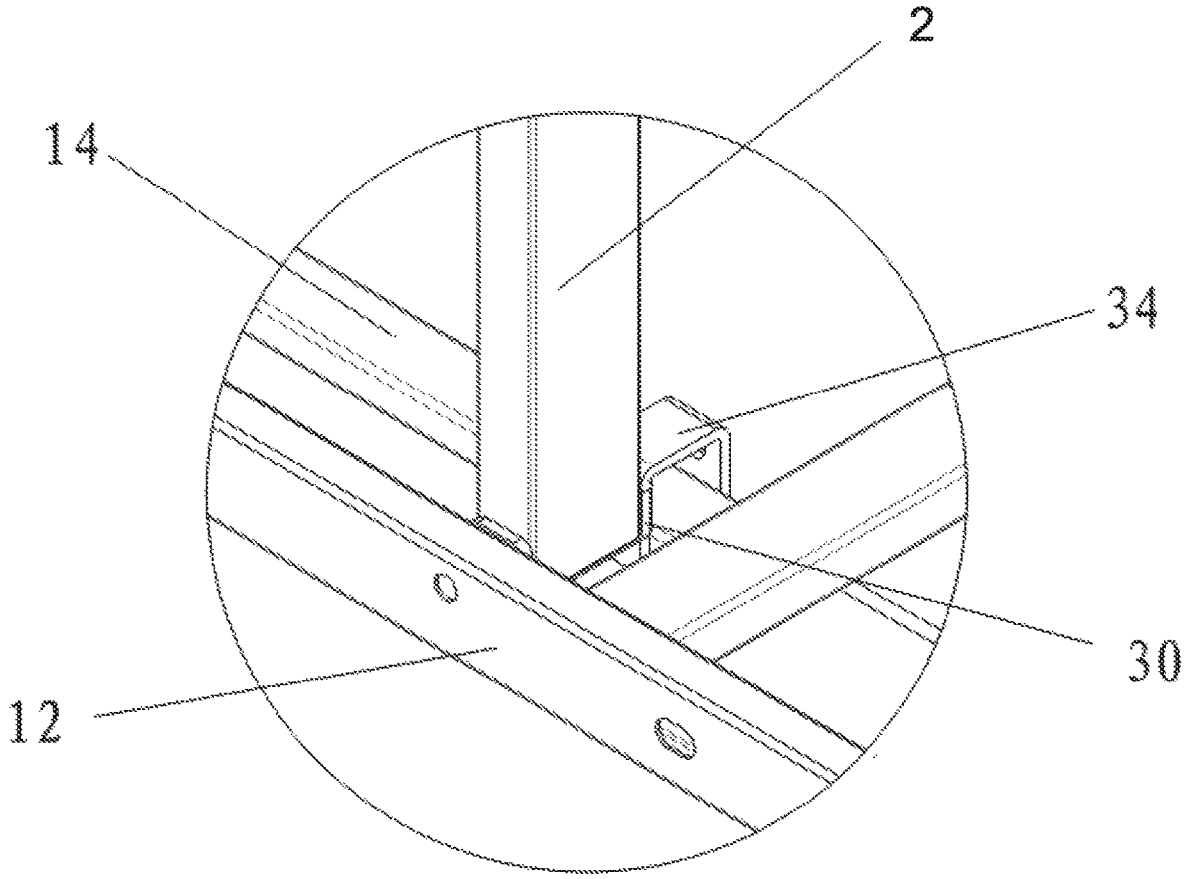
FIG. 3A is an enlarged schematic view taken along circle A in FIG. 1C.
Figure 3C:
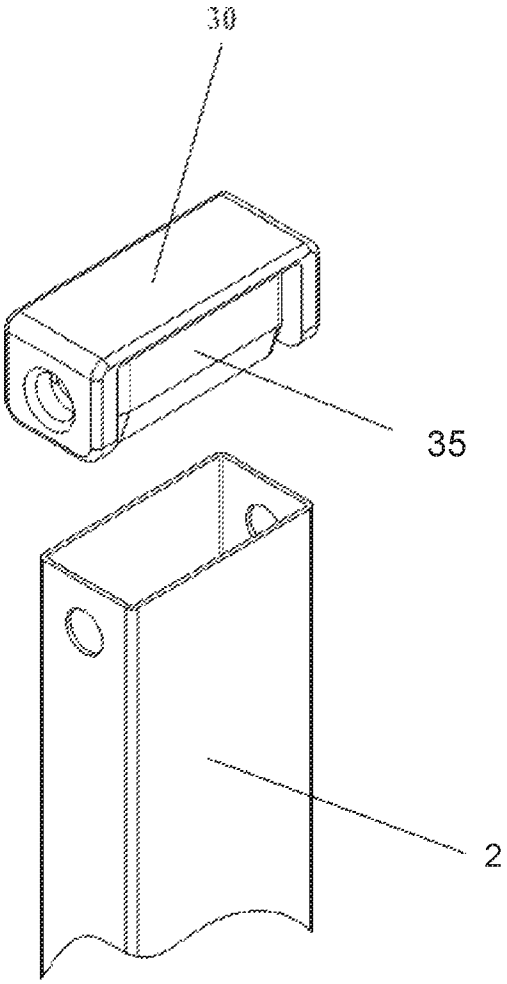
FIG. 3C is a schematic perspective view illustrating an exemplary leg connecting piece of FIG. 3A.
Figure 3B:
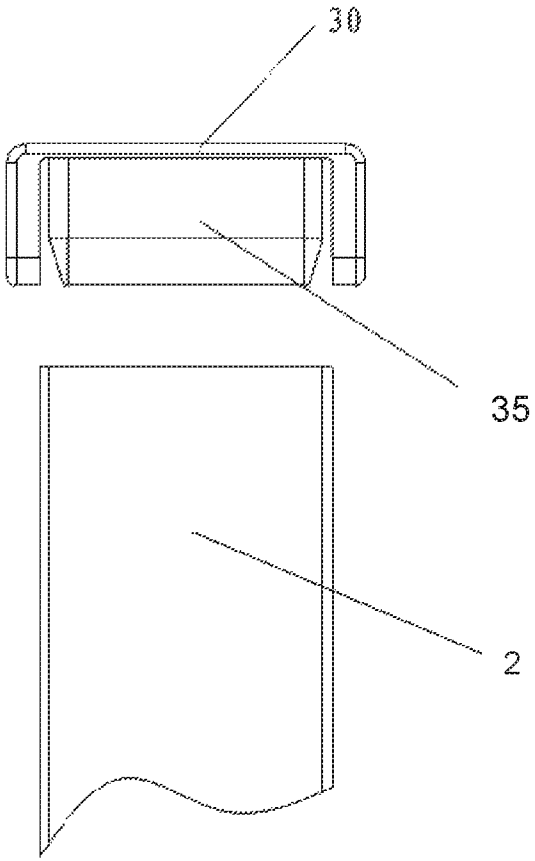
FIG. 3B is a schematic side view illustrating an exemplary leg connecting piece of FIG. 3A.

In some embodiments, the foldable bed frame further includes a plurality of leg limiting pieces such as leg limiting pieces 34 as illustrated in FIG. 3A. Leg limiting piece 34 rotates along with leg connecting piece 30. Leg limiting piece 34 is configured such that when a top surface of limiting piece 34 is perpendicular or substantially perpendicular to the longitudinal interior bar of sub-frame 1, leg 2 is parallel or substantially parallel to the longitudinal peripheral bar of sub-frame 1.

Referring to FIGS. 1A, 1B, 1D, 2A and 2B, in some embodiments, foldable bed frame 100 includes a plurality of sub-frames such as first and second sub-frames 1, a middle leg assembly such as middle leg assembly 200, and a plurality of frame connecting pieces. Each of first and second sub-frames 1 has two ends at its proximal side, and each end is formed with a recess such as recess 221 at the lower side of the sub-frame. Middle leg assembly 200 is disposed between the first and second sub-frames, and includes left and right middle legs such as middle legs 202. The plurality of frame connecting pieces includes left and right frame connecting pieces 204 pivotally connected to left and right middle legs 202, respectively. Each of left and right frame connecting pieces 204 includes a supporting segment such as supporting segment 31 and one or more connecting segments such as connecting segment 32. Supporting segment 31 is formed at the lower portion or the bottom of the frame connecting piece. Connecting segment 32 has a first side pivotally connected to an end of the first sub-frame, and a second side pivotally connected to an end of the second sub-frame. When the foldable bed frame is folded, as illustrated in FIG. 1D, the ends of the supporting segments are positioned in the recesses formed at the lower sides of the ends of the first and second sub-frames. Thus, the thickness of the foldable bed frame when folded is minimized, making the folded bed frame compact and convenient for packing, shipping and transportation.

In some embodiments, frame connecting piece 204 includes two connecting segments 32 substantially parallel to each other and connected to each other by supporting segment 31. In some embodiments, the connecting segment(s) and the supporting segment are monolithically or integrally formed as one piece, for example, by cutting and bending.

Figure 2A:
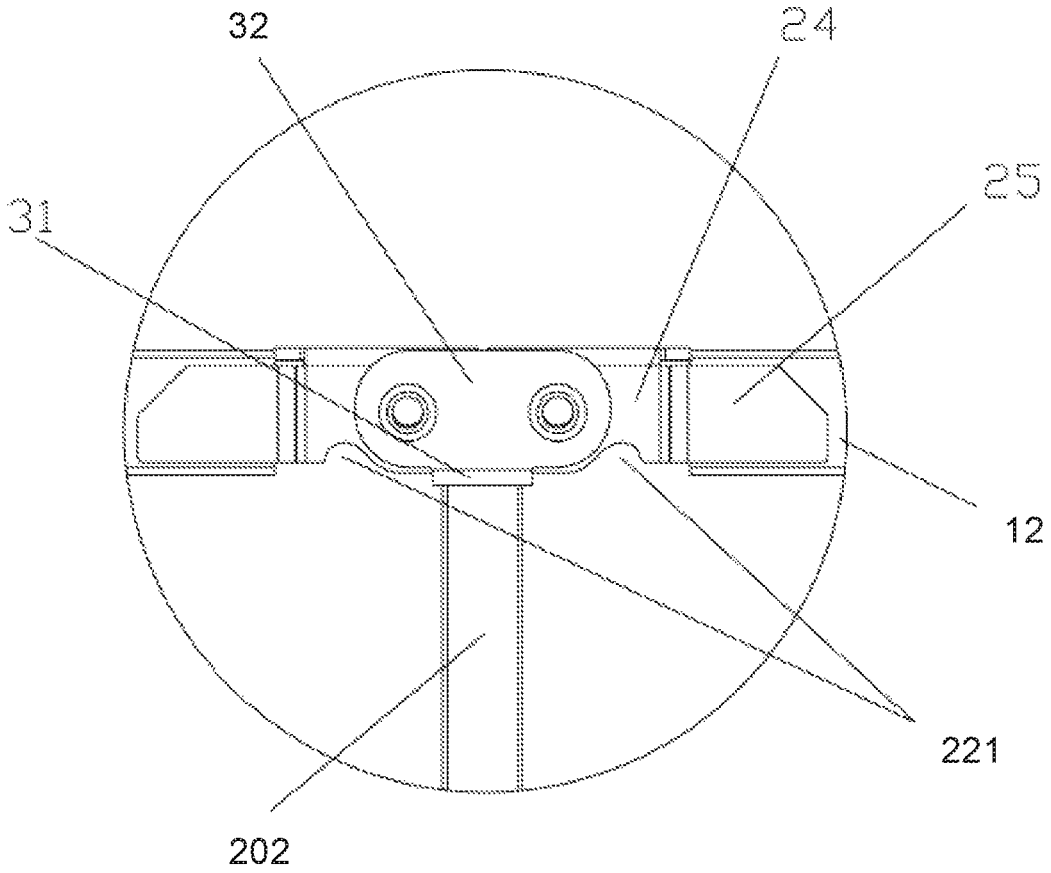
FIG. 2A is an enlarged schematic view taken along circle A in FIG. 1A.
Figure 2B:
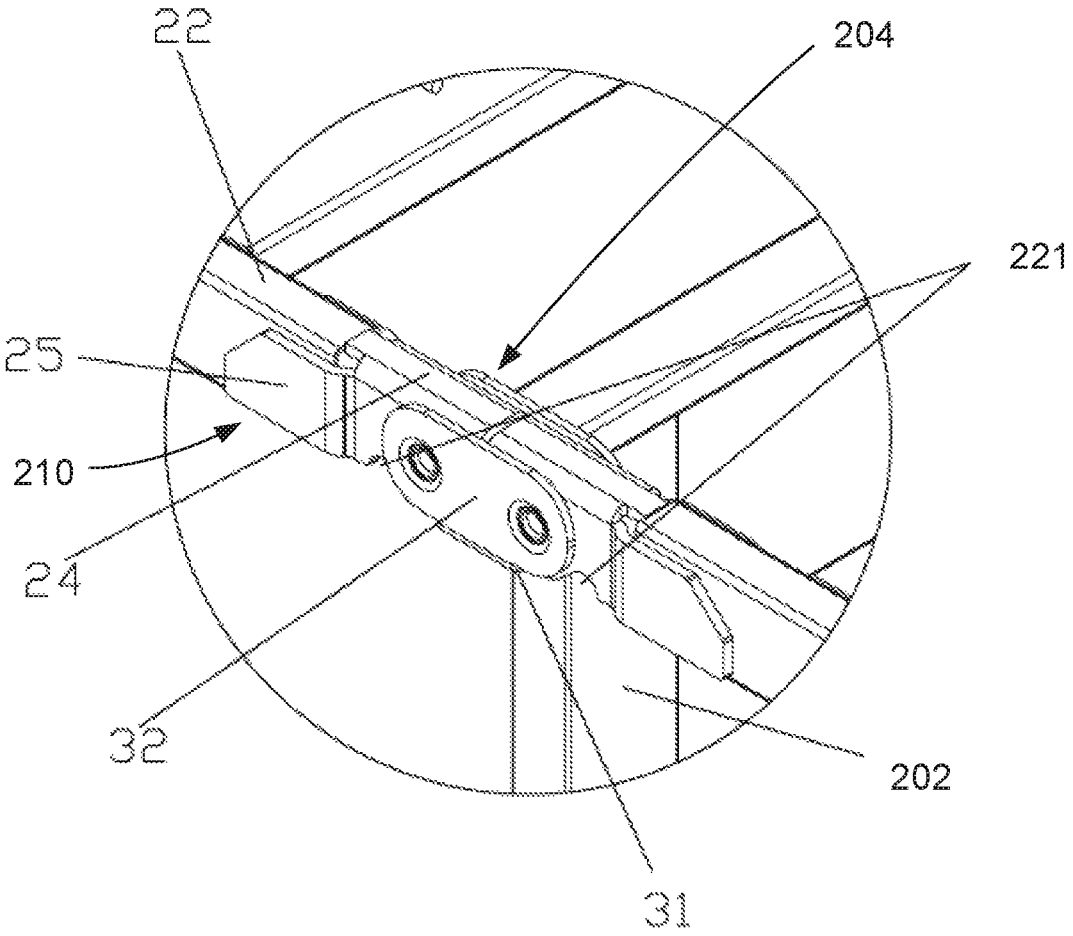
FIG. 2B is an enlarged schematic view taken along circle A in FIG. 1B.

In some embodiments, peripheral frame 12 of sub-frame 1 is formed by a bent bar having substantially a "⊏" shape with two ends such as ends 22. At each end 22, sub-frame 1 further includes bar connecting piece 210 having one or more first segments 25 and second segment 24. By way of example, FIG. 2B illustrates two first segments with end 22 of the bent bar disposed in between. First segments 25 are fixedly connected to end 22 of the bent bar, for example, by welding. Second segment 24 is pivotally connected to frame connecting piece 204, for example, by pins or bolts. In such embodiments, recess 221 is formed at the lower side of second segment 24 of bar connecting piece 210. In some embodiments, the first and second segments of each bar connecting piece are monolithically or integrally formed as one piece.

In some embodiments, foldable bed frame 100 also includes a plurality of supports such as oblique supports 4. Oblique support 4 in general has two ends, with one end connected to a sub-frame such as sub-frame 1 and another end connected to a side leg assembly such as side leg assembly 20. In embodiments where a sub-frame has peripheral or interior bars, the oblique support can be connected to either peripheral or interior bar of the sub-frame. In embodiments where a side leg assembly has legs and a lateral bar connecting the legs, the oblique support can be connected to either a leg or the lateral bar of the side leg assembly.

It should be noted that a foldable bed frame can include any suitable number of oblique supports, and the numbers or the positions of oblique supports for different sub-frames are not necessarily the same. For example, a foldable bed frame can include two oblique supports for each sub-frame, or can have two oblique supports for one sub-frame, and three oblique supports for another sub-frame. Also, it should be noted that the oblique supports can be connected to the side leg assembly and the sub-frame at any suitable positions (symmetric or asymmetric to each other). Further, it should be noted that a foldable bed frame can include different types of oblique supports.

By way of example, FIGS. 1C and 4A-4D illustrates a foldable bed frame of the present invention with a first exemplary oblique support in accordance with some embodiments of the present invention. As shown, side leg assembly 20 includes left and right legs 2 with the left leg pivotally connected to the left side of the sub-frame and the right leg pivotally connected to the right side of the sub-frame. Side leg assembly 20 further includes a lateral bar such as lateral bar 3 connecting the left and right legs. Oblique support 4 has first end 212 pivotally connected to lateral bar 3 of side leg assembly 20 and second end 214 releasably connected to peripheral frame 12. In the illustrated embodiments, the second end of oblique support 4 is releasably connected to the lateral bar or lateral portion of peripheral frame 12 at the proximal side of the sub-frame. It should be noted that first end 212 of oblique support 4 can be releasably connected to peripheral frame 12, and second end 214 of oblique support 4 can be pivotally connected to lateral bar 3 of side leg assembly 20.

In some embodiments, corresponding to an oblique support, the foldable bed frame includes a first connecting piece such as first connecting piece 216 for pivotally coupling first end 212 of oblique support 4 with the side leg assembly. In the illustrated embodiments, first connecting piece 216 is fixedly coupled to the lateral bar of the side leg assembly and pivotally coupled to first end 212 of oblique support 4.

In some embodiments, second end 214 of oblique support 4 is formed with an assembly hole such as assembly hole 220. Corresponding to the oblique support, the foldable bed frame further includes a support connecting mechanism. The support connecting mechanism includes one or more connecting pieces fixedly coupled to the sub-frame, a fastener coupling the oblique support with the connecting pieces and an elastic member restoring the fastener in its initial position.

Figure 4B:
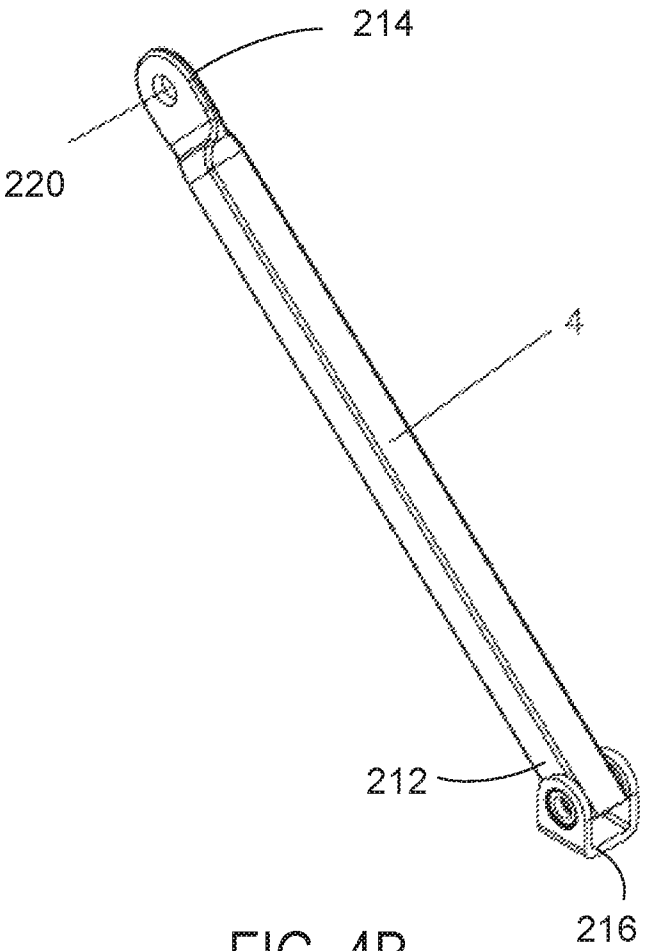
FIG. 4B is a schematic view illustrating a support in accordance with exemplary embodiments of the present invention.
Figure 4A:
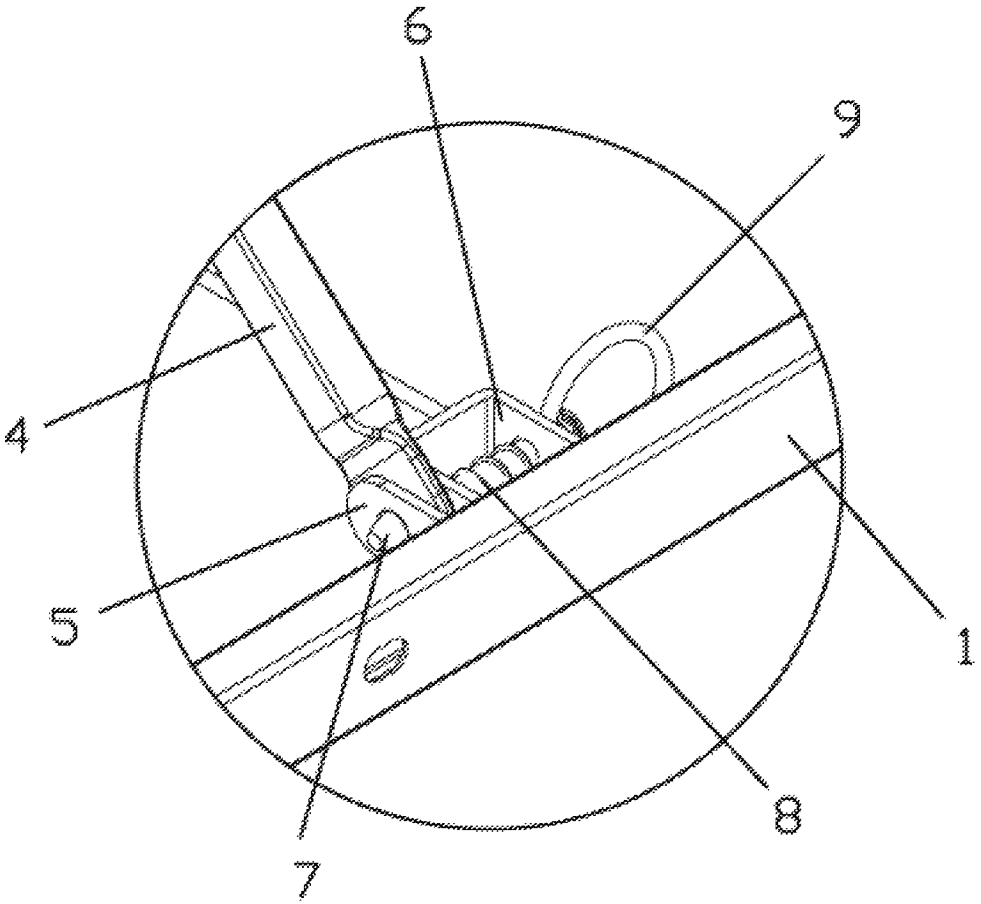
FIG. 4A is an enlarged schematic view taken along circle B in FIG. 1C, illustrating a support connecting mechanism in accordance with exemplary embodiments of the present invention.
Figure 4C:
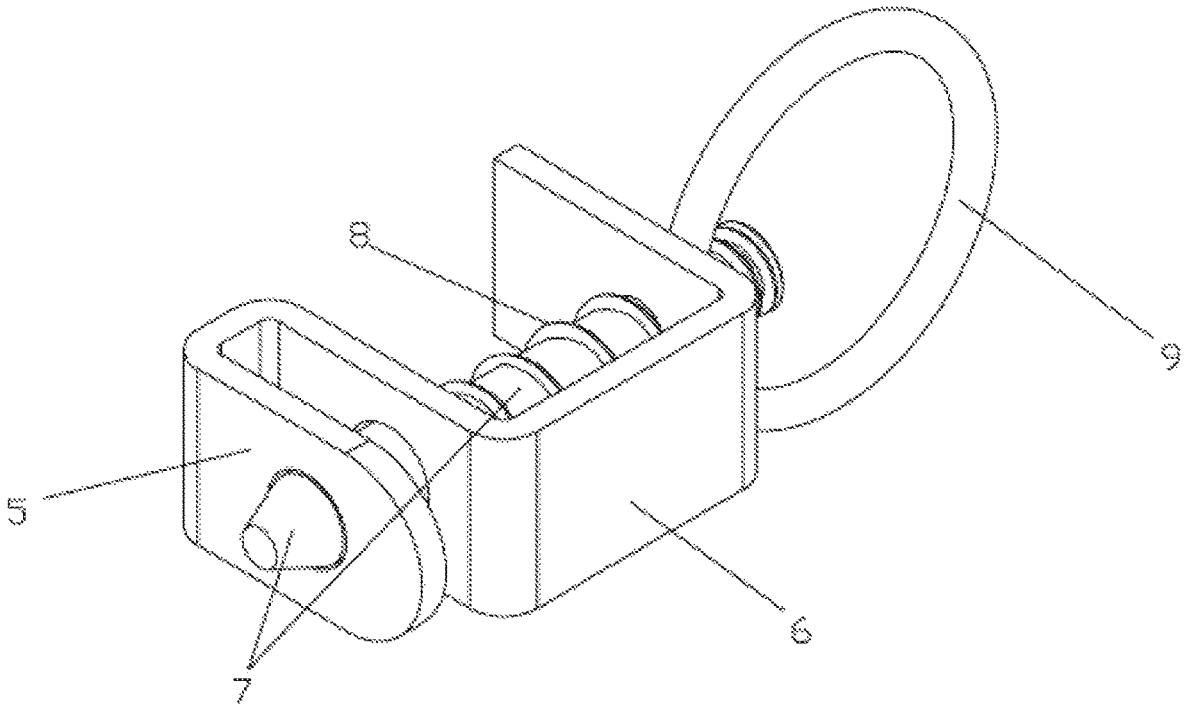
FIGS. 4C and 4D are schematic perspective views illustrating components of the support connecting mechanism of FIG. 4A.
Figure 4D:
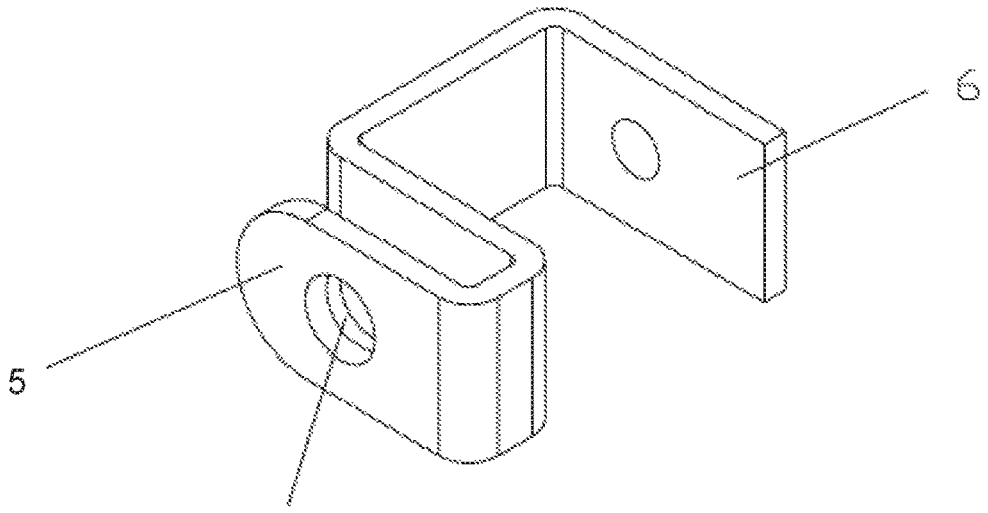

In the illustrated embodiments, the support connecting mechanism includes second connecting piece 5, third connecting piece 6, fastener 7, and spring 8. Connecting piece 5 and third connecting piece 6 can be monolithically or integrally formed (e.g., by bending) as one piece, or formed separately as individual pieces. Second connecting piece 5 is fixedly coupled to the sub-frame (e.g., lateral bar of sub-frame 1) and formed with an assembly hole such as assembly hole 222 corresponding to assembly hole 220 formed at the second end of the oblique support. Third connecting piece 6 is also fixedly coupled to the sub-frame. In some embodiments, third connecting piece 6 has substantially a "⊏" shape with two side segments and a middle segment connecting the two side segments. Each of the two side segments is formed with an assembly hole as shown in FIG. 4D. Preferably, third connecting piece 6 is coupled to a bar of the sub-frame with its opening facing the bar.

Fastener 7 is inserted into the assembly holes formed at the second end of the oblique support, at the second connecting piece and at the third connecting piece. As such, fastener 7 releasably couples the oblique support with the sub-frame. To facilitate insertion, in a preferred embodiment, the end of the fastener proximal to second connecting piece 5 is tapered or rounded.

Spring 8 is disposed between the two side segments of the third connecting piece and coupled to the fastener. In an embodiment, spring 8 sleeves on the fastener, and has one end coupled to the fastener and the other end coupled to the third connecting piece. Spring 8 is used to restore the fastener in its initial position (e.g., a normal state).

In some embodiments, the support connecting mechanism further includes a pull means such as pull ring 9 coupled to an end of the fastener distal from second connecting piece 5.

In a normal state, the proximal end of the fastener is inserted into the assembly holes formed at the second connecting piece and at the third connecting piece. To assemble the bed frame, the fastener is first pulled out of the assembly hole of the second connecting piece by, for example, pulling the pull ring. Then, the second end of the oblique support is placed between the second and third connecting pieces, and the assembly holes are aligned. Afterward, the pull ring is released. At this stage, the fastener is pushed by the elastic member (e.g., spring 8) into the assembly holes of the oblique support and the second connecting piece, thereby coupling the oblique support with the sub-frame.

Referring to FIGS. 5A-7B, there is depicted a foldable bed frame of the present invention with a second exemplary oblique support and its variations in accordance with some embodiments of the present invention. As shown, second exemplary oblique support 4 has two ends, each having a lug-like portion such as lug 41. Lug 41 can be bent or straight with respect to the main portion of the oblique support. By way of illustration, FIGS. 5A-7B show a bent lug. One lug 41 is connected to lateral bar 3 of leg assembly 20 and the other lug 41 is connected to the peripheral lateral bar or portion of sub-frame 1. In some embodiments, for each sub-frame, the foldable bed frame includes two oblique supports disposed on the left and right sides of the foldable bed frame and proximal to the left and right legs respectively.

Figure 5A:
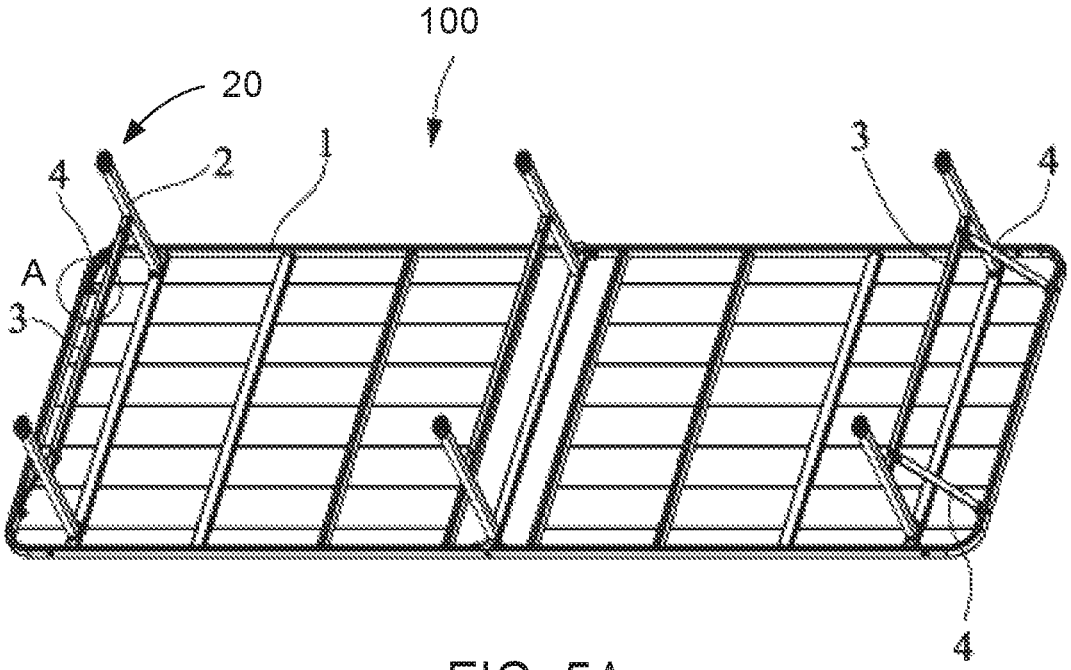
FIG. 5A is a schematic bottom perspective view illustrating a foldable bed frame in an unfolded state with a second exemplary support in accordance with exemplary embodiments of the present invention.
Figure 5B:
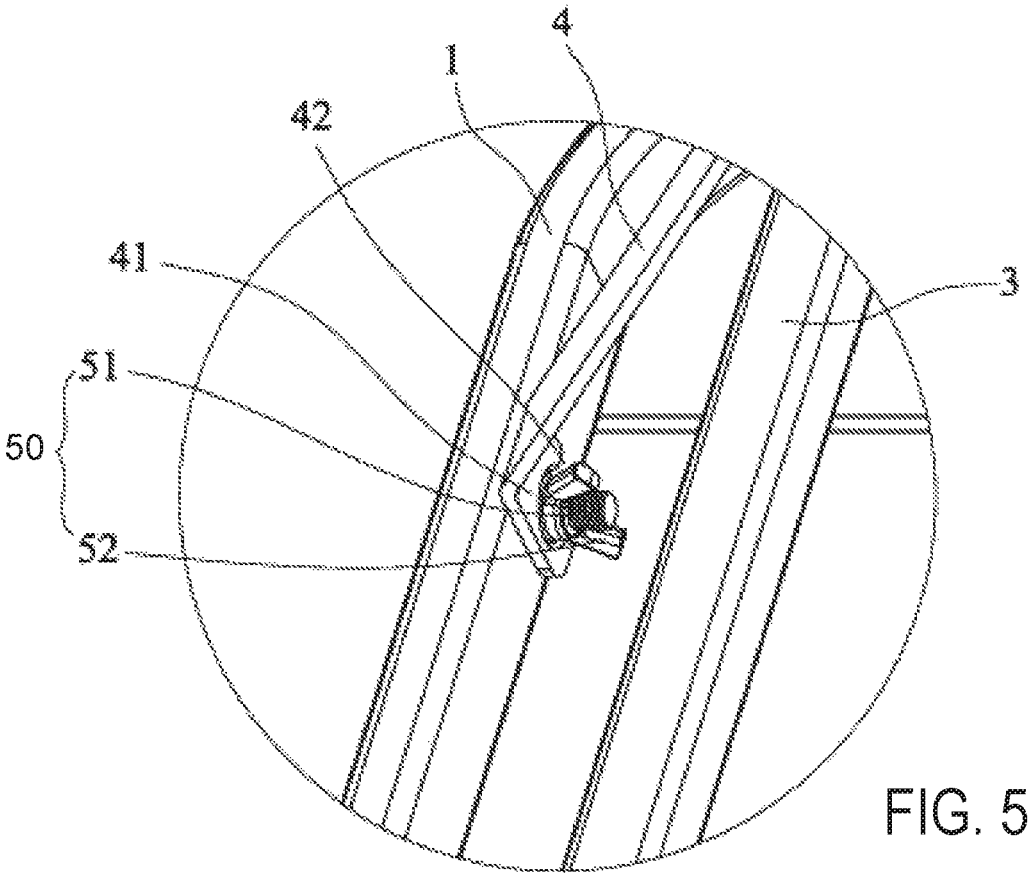
FIG. 5B is an enlarged schematic view taken along circle A in FIG. 5A.

In the embodiment illustrated in FIGS. 5A and 5B, one lug 41 of the oblique support is formed with a through hole, and the other lug 41 (either the end to be connected to the side leg assembly or to be connected to the sub-frame) is formed with an open slot such as open slot 42. Open slot 42 can be of "U"-shape, "C"-shape or any other suitable shape. Corresponding to the through hole and the open slot of the oblique support, lateral bar 3 of leg assembly 20, and the peripheral lateral bar or portion of sub-frame 1 are formed with an assembly hole for coupling with the oblique support. Corresponding to open slot 42, the foldable frame assembly includes a fastener such as fastener 50 (e.g., bolt 51 and nut 52) for releasably and/or adjustably fastening the oblique support to the side leg assembly or the sub-frame.

Figure 6A:
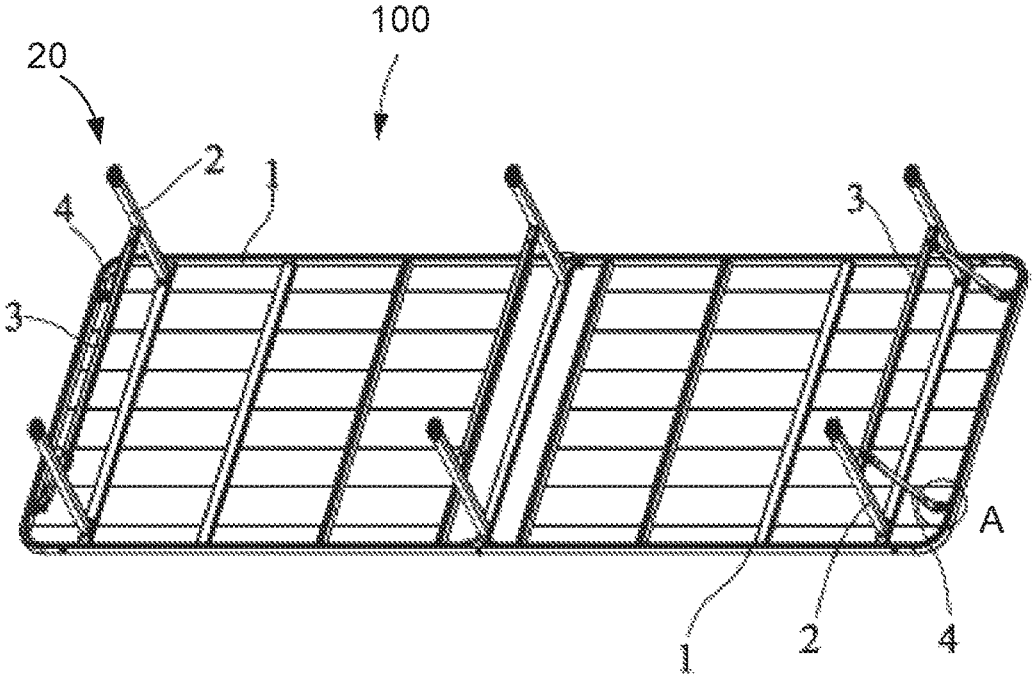
FIG. 6A is a schematic bottom perspective view illustrating the foldable bed frame of FIG. 5A with a variation of the second exemplary support.
Figure 6B:
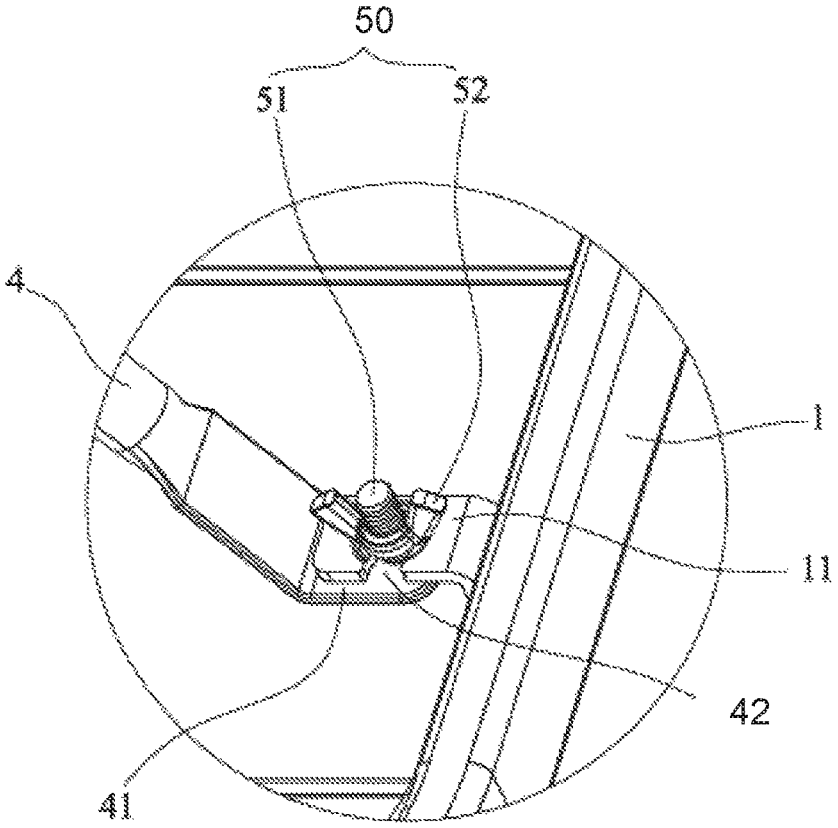
FIG. 6B is an enlarged schematic view taken along circle A in FIG. 6A.

In the embodiment illustrated in FIGS. 6A and 6B, each of the two lugs 41 is formed with a through hole. Corresponding to the through holes of the oblique support, lateral bar 3 of leg assembly 20 is formed with an assembly hole for coupling with the oblique support. Sub-frame 1 includes a connecting piece such as connecting piece 11 fixedly coupled to the peripheral lateral bar or portion of sub-frame 1. Connecting piece 11 is formed with an open slot such as open slot 42. Open slot 42 can be of "U"-shape, "C"-shape or any other suitable shapes. Corresponding to open slot 42, the foldable frame assembly includes a fastener such as fastener 50 (e.g., bolt 51 and nut 52) for releasably and/or adjustably fastening the oblique support to connecting piece 11 fixedly disposed on the sub-frame.

Figure 7A:
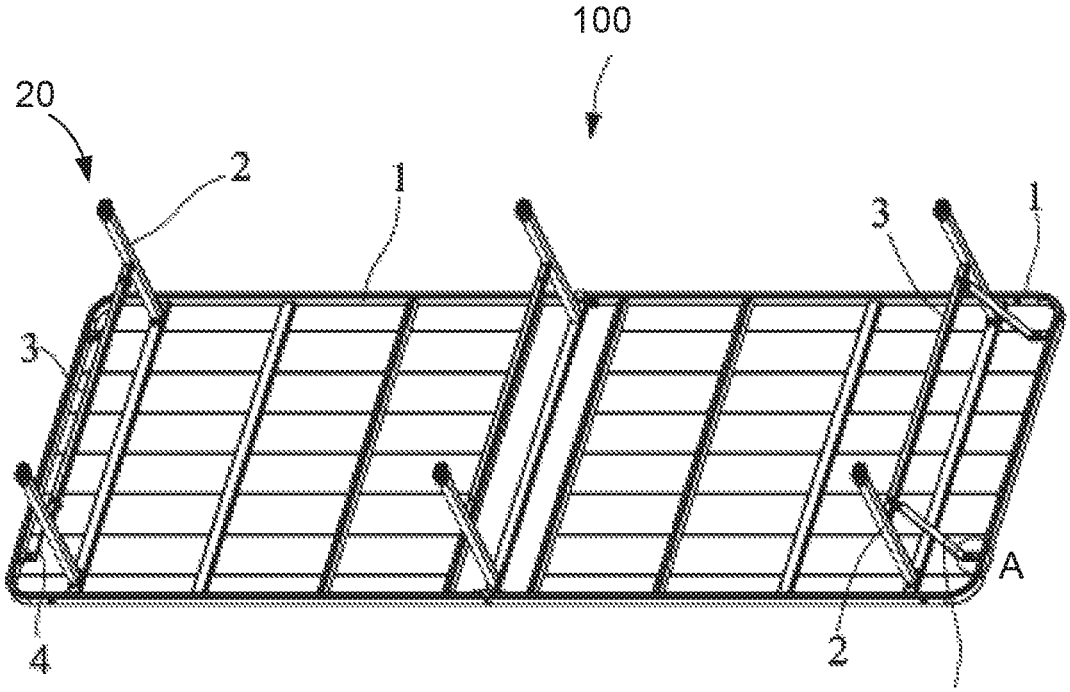
FIG. 7A is a schematic bottom perspective view illustrating the foldable bed frame of FIG. 5A with another variation of the second exemplary support.
Figure 7B:
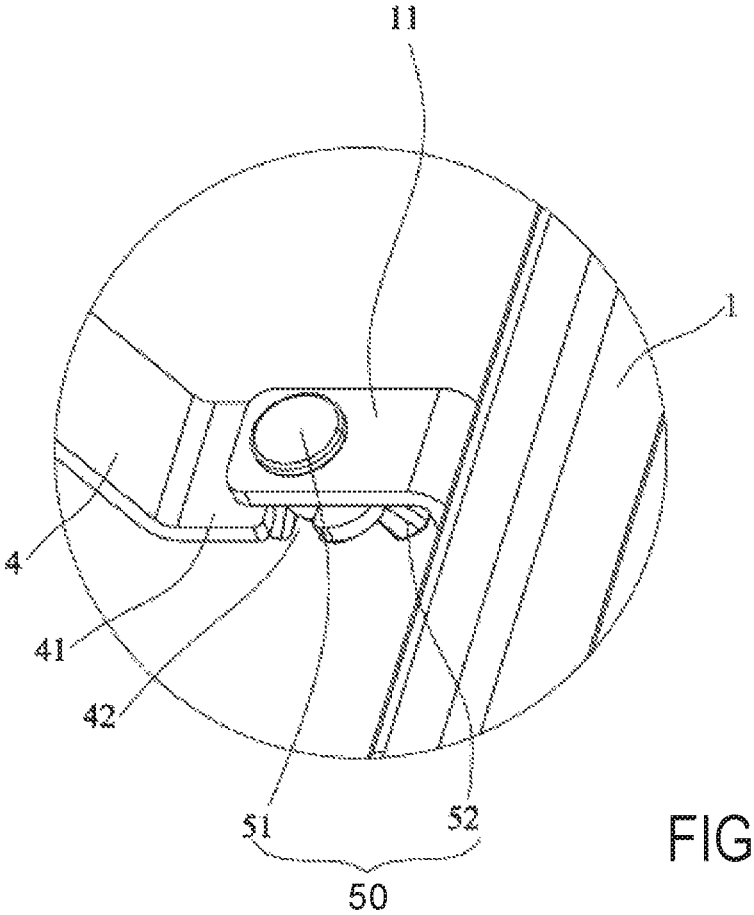
FIG. 7B is an enlarged schematic view taken along circle A in FIG. 7A.

In the embodiment illustrated in FIGS. 7A and 7B, one lug 41 of the oblique support is formed with a through hole, and the other lug 41 is formed with an open slot such as open slot 42. Corresponding to the through hole of the oblique support, lateral bar 3 of leg assembly 20 is formed with an assembly hole for coupling with the oblique support. Corresponding to open slot 42 of the oblique support, sub-frame 1 includes a connecting piece such as connecting piece 11 fixedly coupled to the peripheral lateral bar or portion of sub-frame 1. Connecting piece 11 is formed with a through hole. Corresponding to open slot 42, the foldable frame assembly includes a fastener such as fastener 50 (e.g., bolt 51 and nut 52) for releasably and/or adjustably fastening the oblique support to connecting piece 11 fixedly disposed on the sub-frame.

Referring to FIGS. 8A-10B, there is depicted a foldable bed frame of the present invention with a third exemplary oblique support and its variations in accordance with some embodiments of the present invention. Like the second exemplary oblique support, the third exemplary oblique support has two ends, each having a lug-like portion such as lug 41. Unlike the second exemplary oblique support, the third exemplary oblique support is not connected to lateral bar 3 of leg assembly 20; instead, it is connected to leg 2 of leg assembly 20.

Figure 8A:
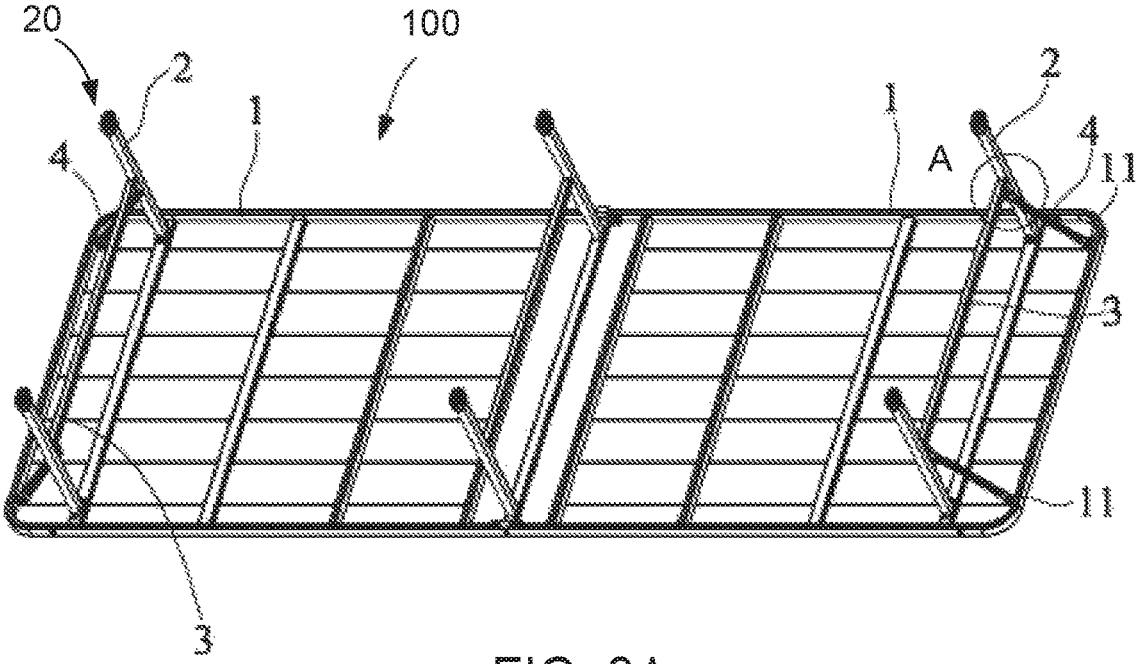
FIG. 8A is a schematic bottom perspective view illustrating a foldable bed frame in an unfolded state with a third exemplary support in accordance with exemplary embodiments of the present invention.
Figure 8B:
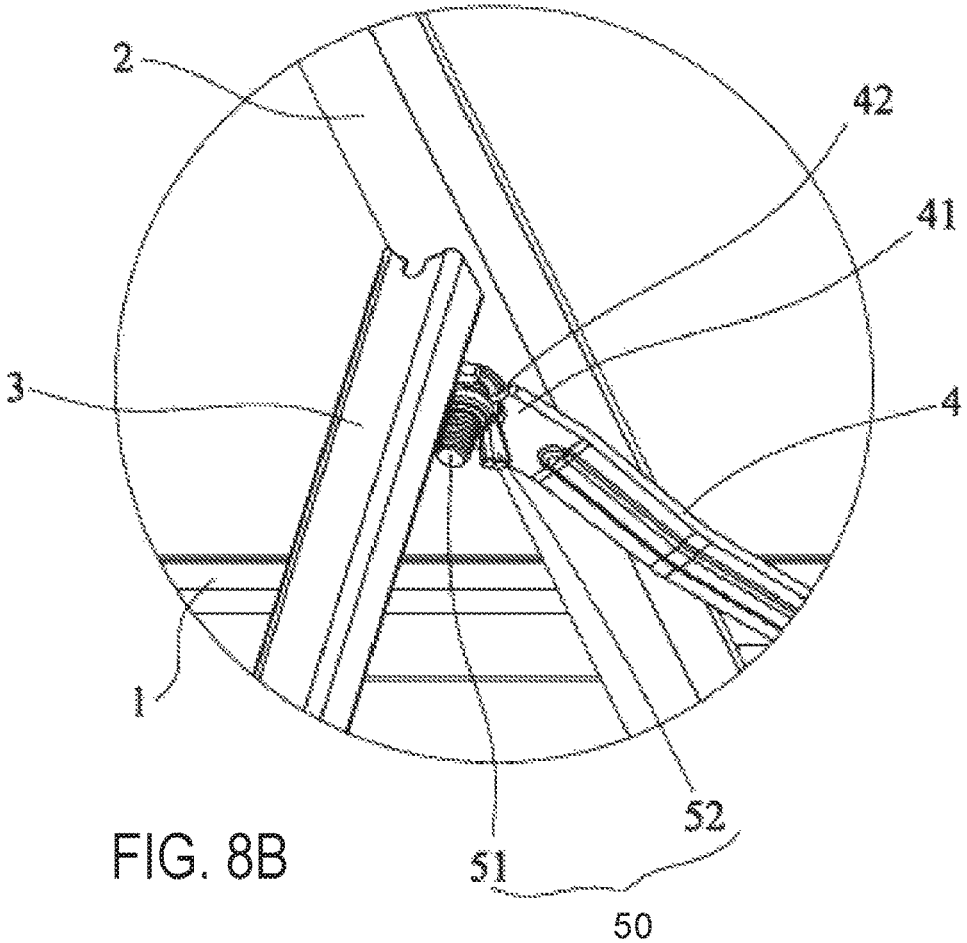
FIG. 8B is an enlarged schematic view taken along circle A in FIG. 8A.

In the embodiment illustrated in FIGS. 8A and 8B, one lug 41 of the oblique support is formed with a through hole, and the other lug 41 is formed with an open slot such as open slot 42. Open slot 42 can be of "U"-shape, "C"-shape or any other suitable shapes. The lug with open slot 42 can be used to connect with the side leg assembly or with the sub-frame. By way of example, FIG. 8B illustrates the lug with open slot 42 connected to leg 2 of leg assembly 20. Corresponding to the open slot of the oblique support, leg 2 is formed with an assembly hole for coupling with the oblique support. Corresponding to open slot 42, the foldable frame assembly includes a fastener such as fastener 50 (e.g., bolt 51 and nut 52) for releasably and/or adjustably fastening the oblique support to the side leg assembly or the sub-frame. Corresponding to the through hole of the oblique support, in one embodiment, the peripheral lateral bar or portion of sub-frame 1 is formed with an assembly hole for coupling with the oblique support; and in another embodiment, the assembly hole for coupling with the oblique support is formed at a connecting piece such as connecting piece 11 fixedly disposed at the sub-frame.

Figure 9A:
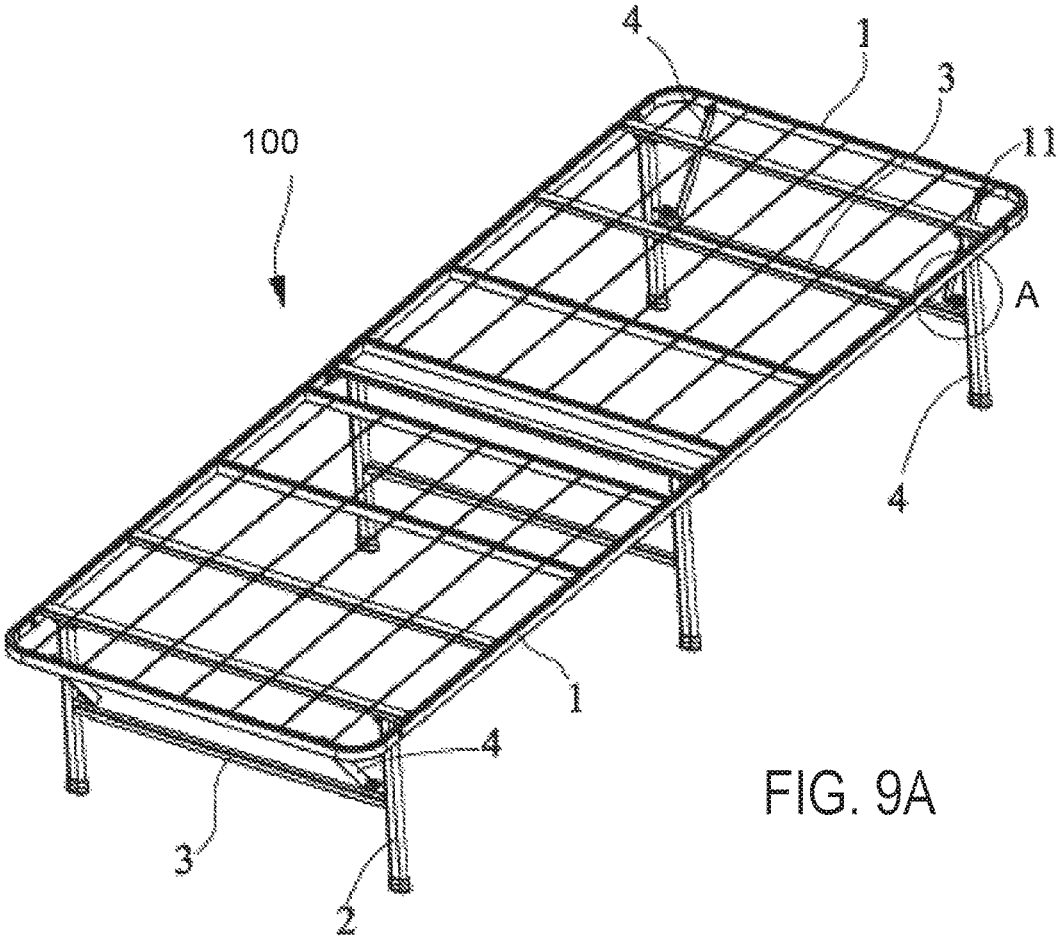
FIG. 9A is a schematic bottom perspective view illustrating the foldable bed frame of FIG. 8A with a variation of the third exemplary support.
Figure 9B:
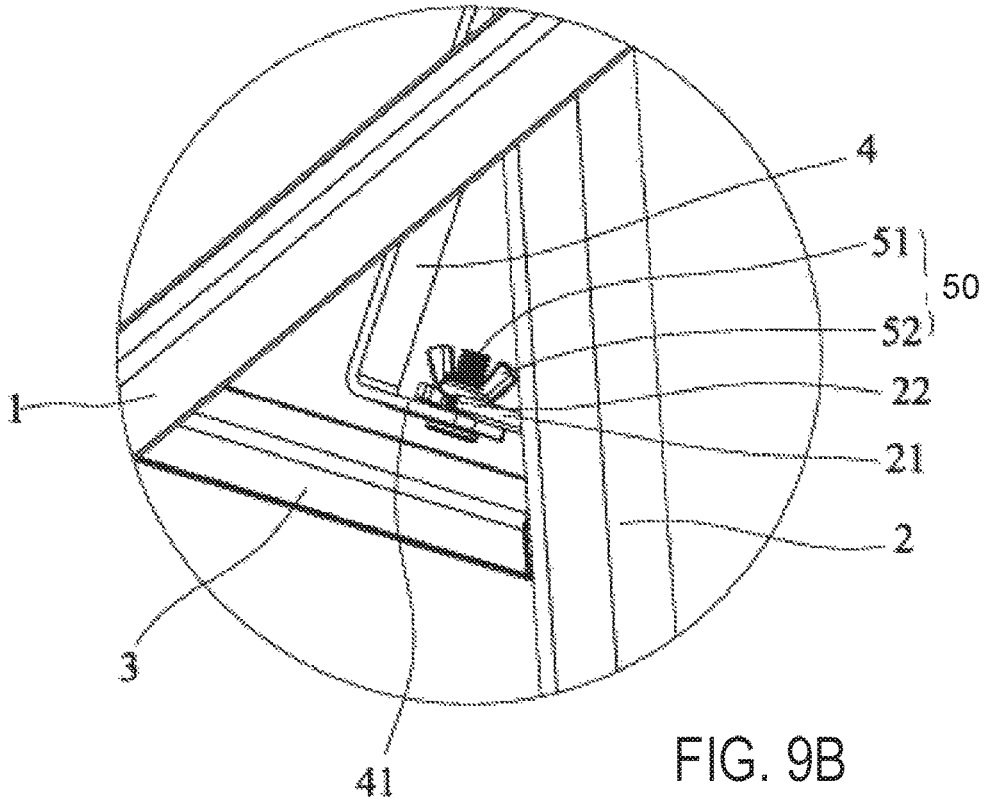
FIG. 9B is an enlarged schematic view taken along circle A in FIG. 9A.

In the embodiment illustrated in FIGS. 9A and 9B, each of the two lugs 41 is formed with a through hole. Corresponding to the oblique support, sub-frame 1 includes a connecting piece such as connecting piece 11 fixedly coupled to the peripheral lateral bar or portion of sub-frame 1, and side leg assembly 20 includes a connecting piece such as connecting piece 21 fixedly coupled to leg 2 of side leg assembly 20. Corresponding to the through holes of the oblique support, connecting piece 11 is formed with an assembly hole and connecting piece 21 is formed with an open slot such as open slot 22 for coupling with the oblique support. Open slot 22 can be of "U"-shape, "C"-shape or any other suitable shapes. Corresponding to open slot 22, the foldable frame assembly includes a fastener such as fastener 50 (e.g., bolt 51 and nut 52) for releasably and/or adjustably fastening the oblique support to connecting piece 21 fixedly disposed on the leg.

Figure 10A:
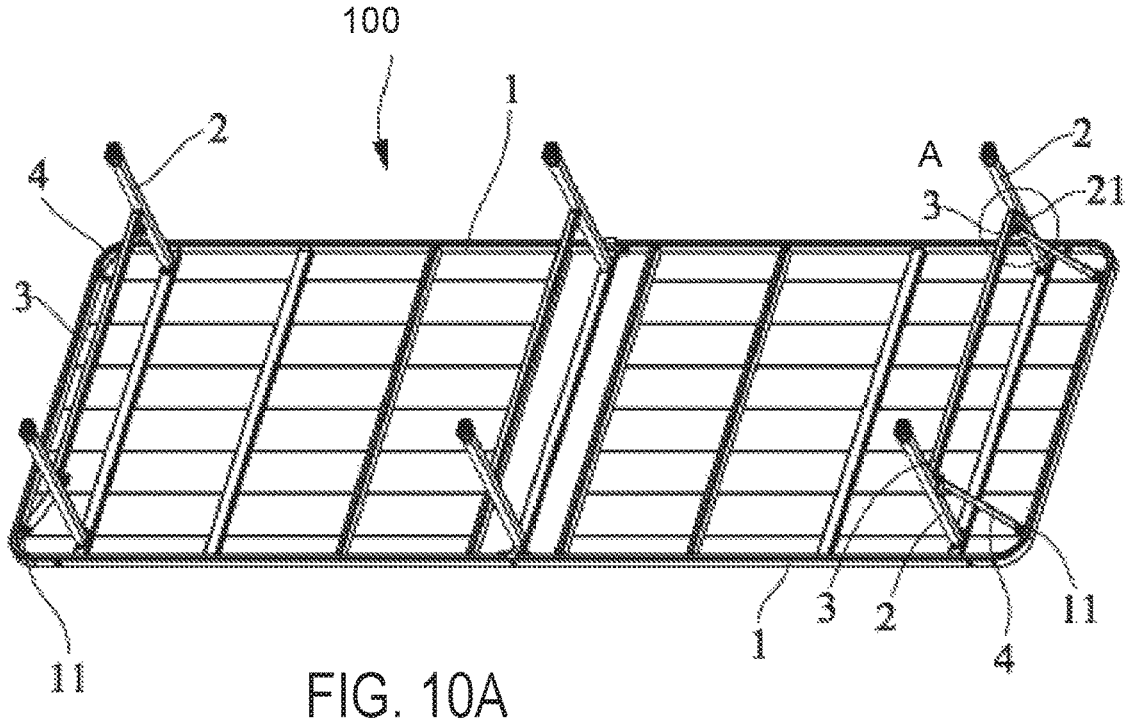
FIG. 10A is a schematic bottom perspective view illustrating a foldable bed frame in an unfolded state with a fourth exemplary support in accordance with exemplary embodiments of the present invention.
Figure 10B:
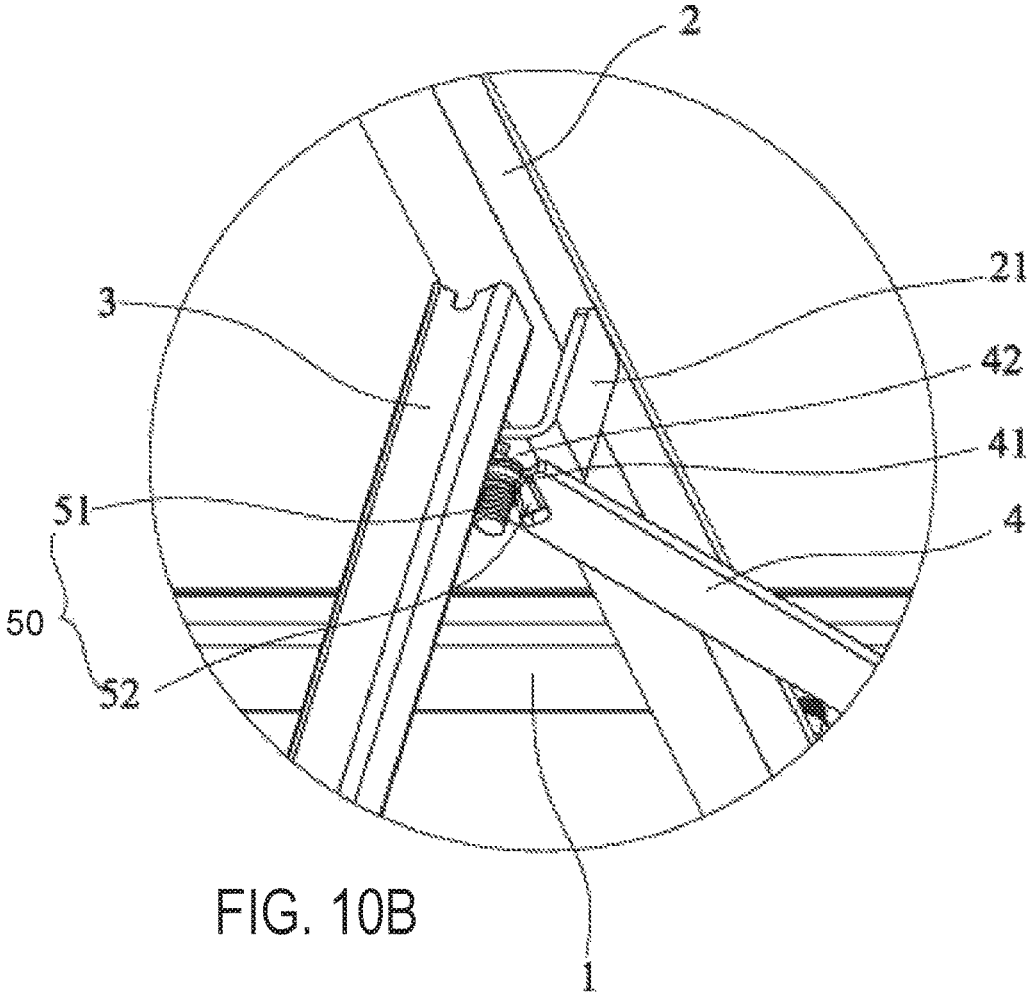
FIG. 10B is an enlarged schematic view taken along circle A in FIG. 10A.

In the embodiment illustrated in FIGS. 10A and 10B, one lug 41 of the oblique support is formed with a through hole, and the other lug 41 is formed with an open slot such as open slot 42. Open slot 42 can be of "U"-shape, "C"-shape or any other suitable shapes. The lug with open slot 42 can be used to connect with the side leg assembly or with the sub-frame. By way of example, FIG. 10B illustrates the lug with open slot 42 connected to leg 2 of leg assembly 20. Corresponding to the through hole and the open slot of the oblique support, each of connecting pieces 11 and 21 is formed with an assembly hole.

Corresponding to open slot 42, the foldable frame assembly includes a fastener such as fastener 50 (e.g., bolt 51 and nut 52) for releasably and/or adjustably fastening the oblique support to connecting piece 21 fixedly disposed on the leg.

Referring to FIGS. 11A-12B, there depicts a foldable bed frame of the present invention with a fourth exemplary oblique support and its variation in accordance with some embodiments of the present invention. Like the second exemplary oblique support, the fourth exemplary oblique support has two ends, each formed with lug 41. One lug 41 is connected to lateral bar 3 of leg assembly 20 and the other connected to sub-frame 1. Connection of the oblique surface to the side leg assembly and the sub-frame can be either directly or through connecting pieces.

Figure 11A:
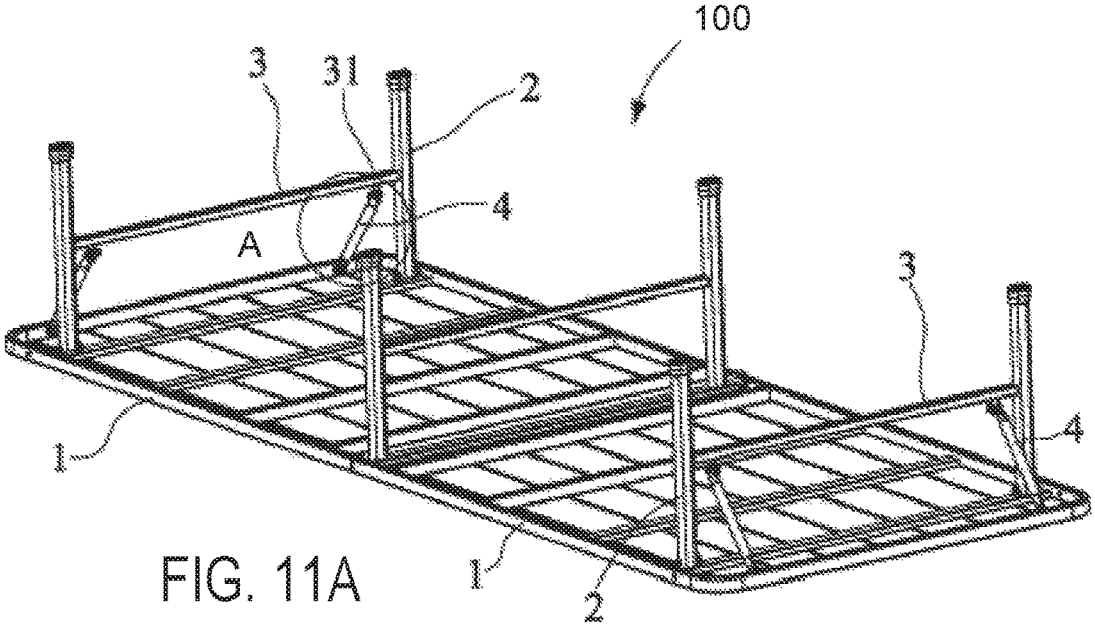
FIG. 11A is a schematic bottom perspective view illustrating the foldable bed frame of FIG. 10A with a variation of the fourth exemplary support.
Figure 11B:
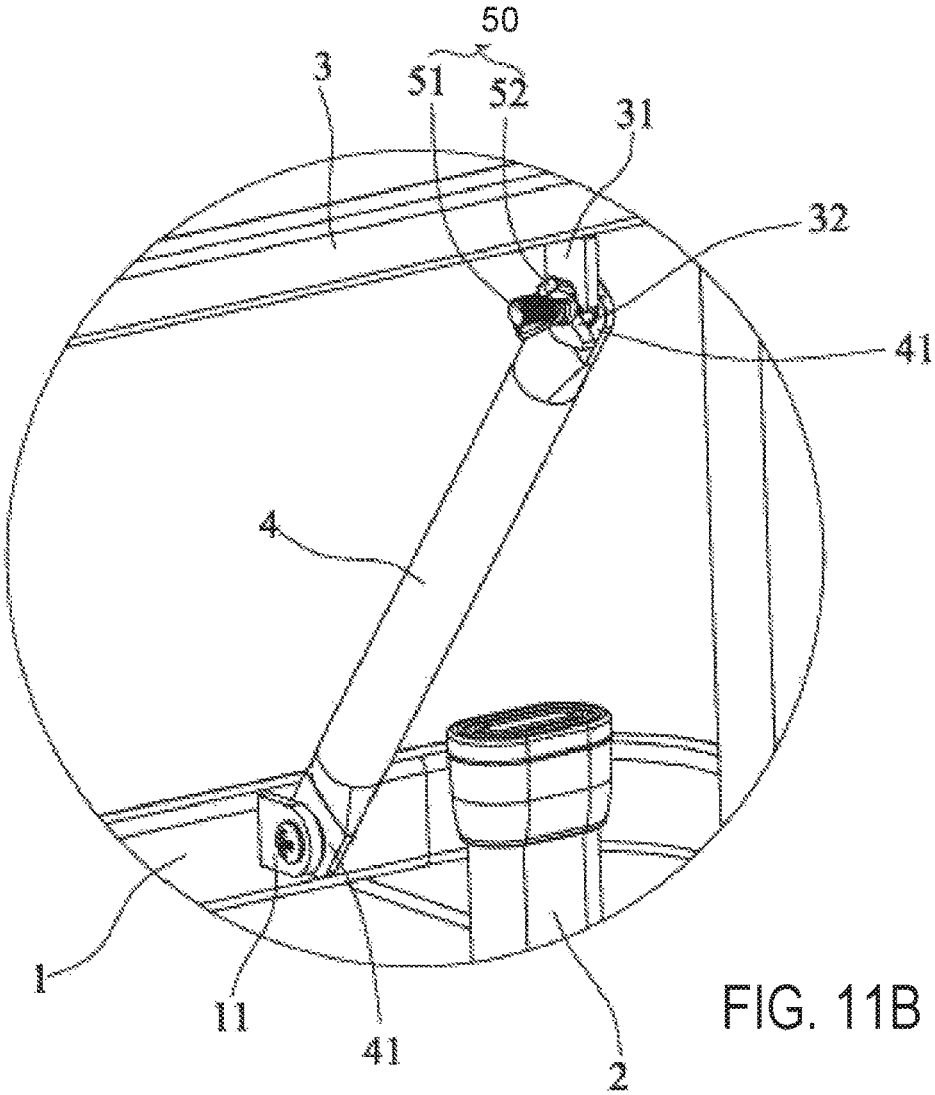
FIG. 11B is an enlarged schematic view taken along circle A in FIG. 11A.

In the embodiment illustrated in FIGS. 11A and 11B, corresponding to oblique support 4, sub-frame 1 includes a connecting piece such as connecting piece 11 fixedly coupled to the peripheral lateral bar or portion of sub-frame 1, and side leg assembly 20 includes a connecting piece such as connecting piece 31 fixedly coupled to lateral bar 3 of side leg assembly 20. Each lug 41 of oblique support 4 is formed with a through hole. Corresponding to the through holes of the oblique support, connecting piece 11 is formed with an assembly hole and connecting piece 31 is formed with an open slot such as open slot 22 for coupling with the oblique support. Open slot 42 can be of "U"-shape, "C"-shape or any other suitable shapes. Corresponding to open slot 42, the foldable frame assembly includes a fastener such as fastener 50 (e.g., bolt 51 and nut 52) for releasably and/or adjustably fastening the oblique support to connecting piece 31 fixedly disposed on the lateral bar of the side leg assembly. In an alternative embodiment, connecting piece 11 is formed with an open slot and connecting piece 31 is formed with an assembly hole.

Figure 12A:
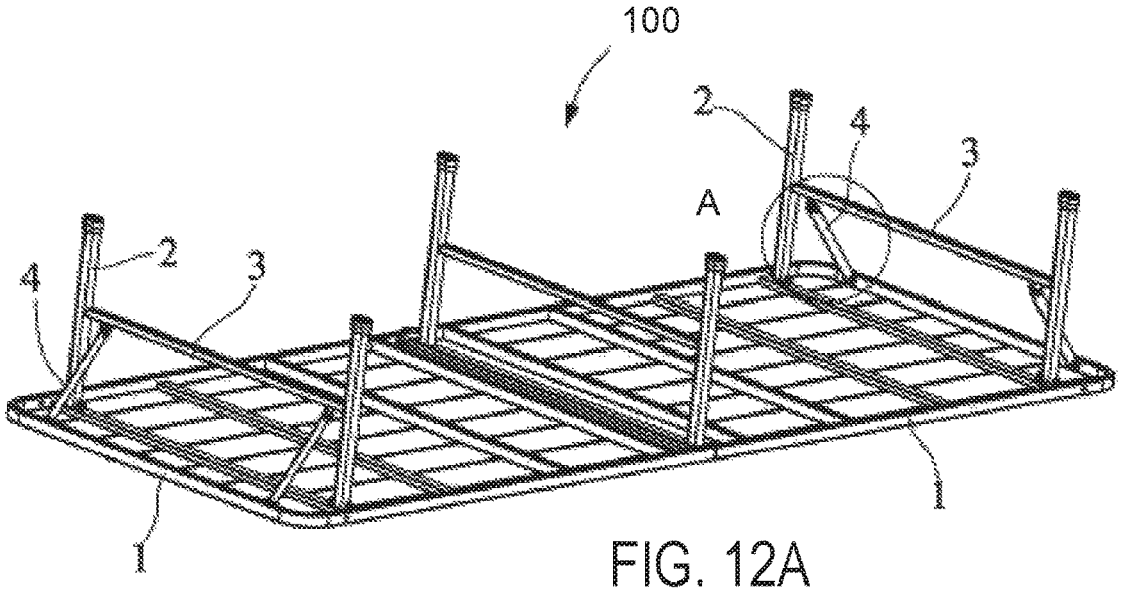
FIG. 12A is a schematic bottom perspective view illustrating the foldable bed frame of FIG. 10A with another variation of the fourth exemplary support.
Figure 12B:
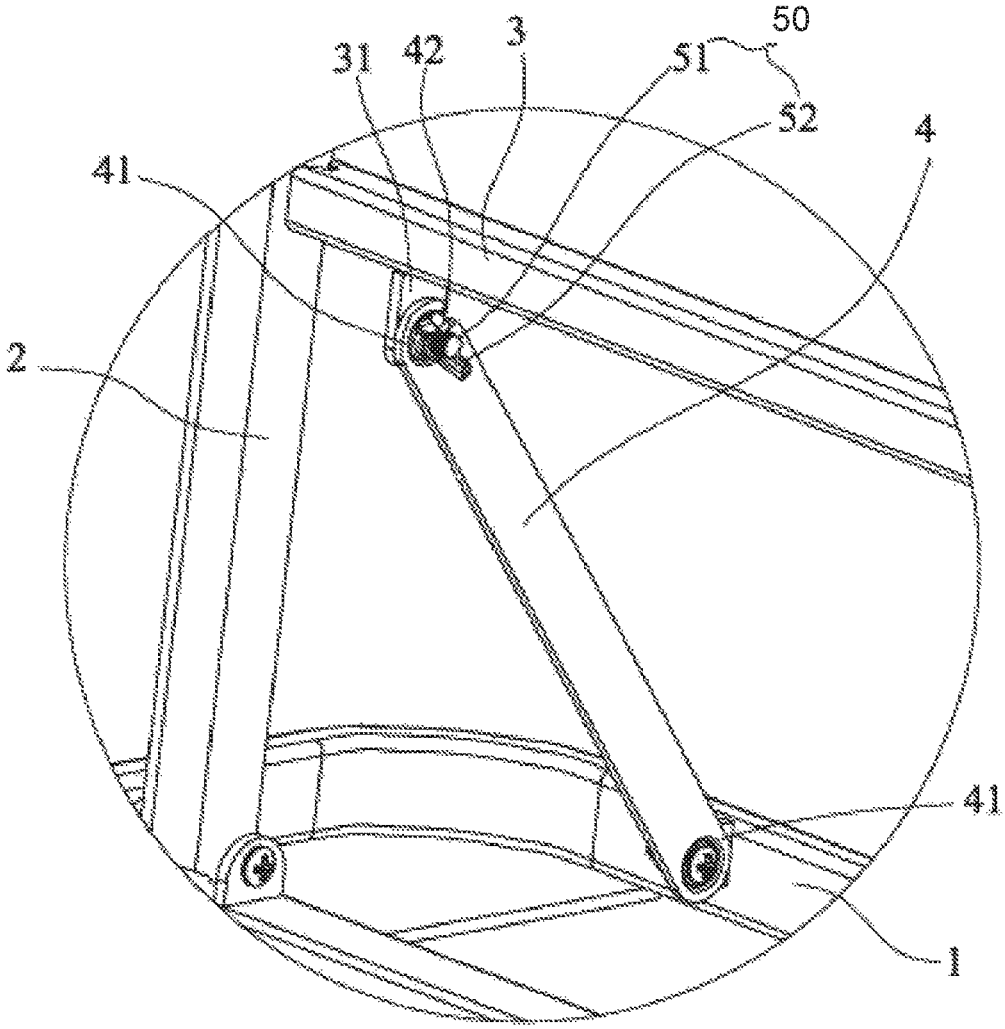
FIG. 12B is an enlarged schematic view taken along circle A in FIG. 12A.

In the embodiment illustrated in FIGS. 12A and 12B, one lug 41 of the oblique support is formed with a through hole, and the other lug 41 is formed with an open slot such as open slot 42. The lug with open slot 42 can be used to connect with the side leg assembly or with the sub-frame. By way of example, FIG. 12B illustrates the lug with open slot 42 connected to lateral bar 3 of leg assembly 20. Corresponding to the through hole and the open slot of the oblique support, each of connecting pieces 11 and 31 is formed with an assembly hole. Corresponding to open slot 42, the foldable frame assembly includes a fastener such as fastener 50 for releasably and/or adjustably fastening the oblique support to connecting piece 31 fixedly disposed on the lateral bar of the side leg assembly.

Referring to FIGS. 13A-15B, there depicts a foldable bed frame of the present invention with a fifth exemplary oblique support and its variations in accordance with some embodiments of the present invention. Similar to the second exemplary oblique support, the fifth exemplary oblique support has two ends, each formed with lug 41. One lug 41 is connected to lateral bar 3 of leg assembly 20 and the other connected to sub-frame 1. Connection of the oblique surface to the side leg assembly and the sub-frame can be either directly or through connecting pieces.

Figure 13A:
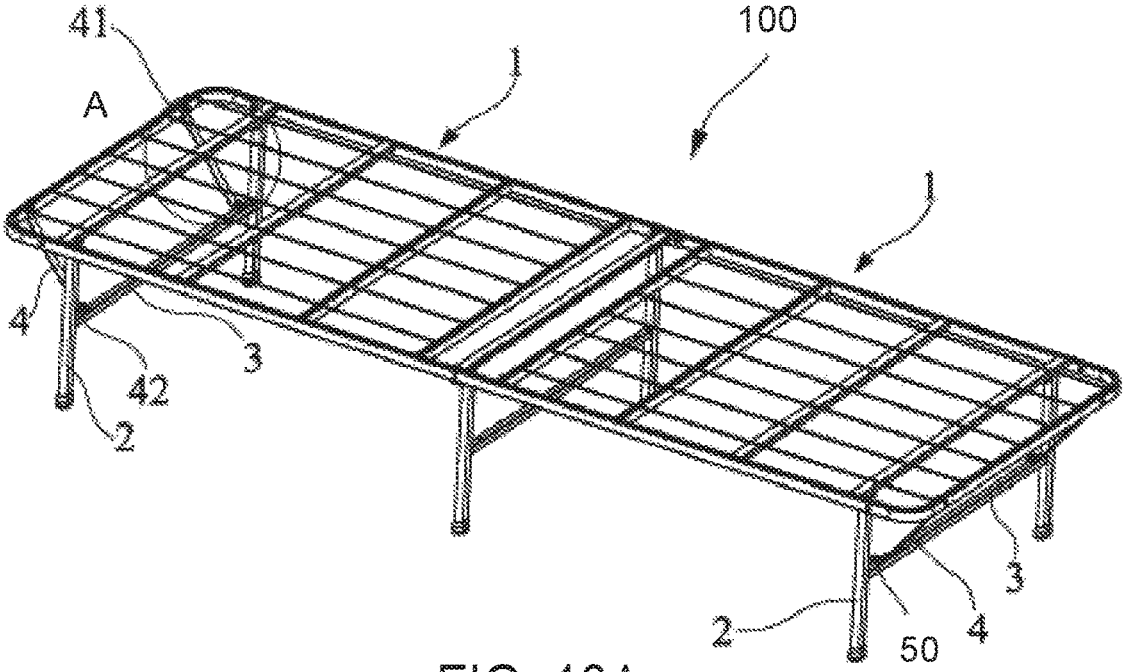
FIG. 13A is a schematic bottom perspective view illustrating a foldable bed frame in an unfolded state with a fifth exemplary support in accordance with exemplary embodiments of the present invention.
Figure 13B:
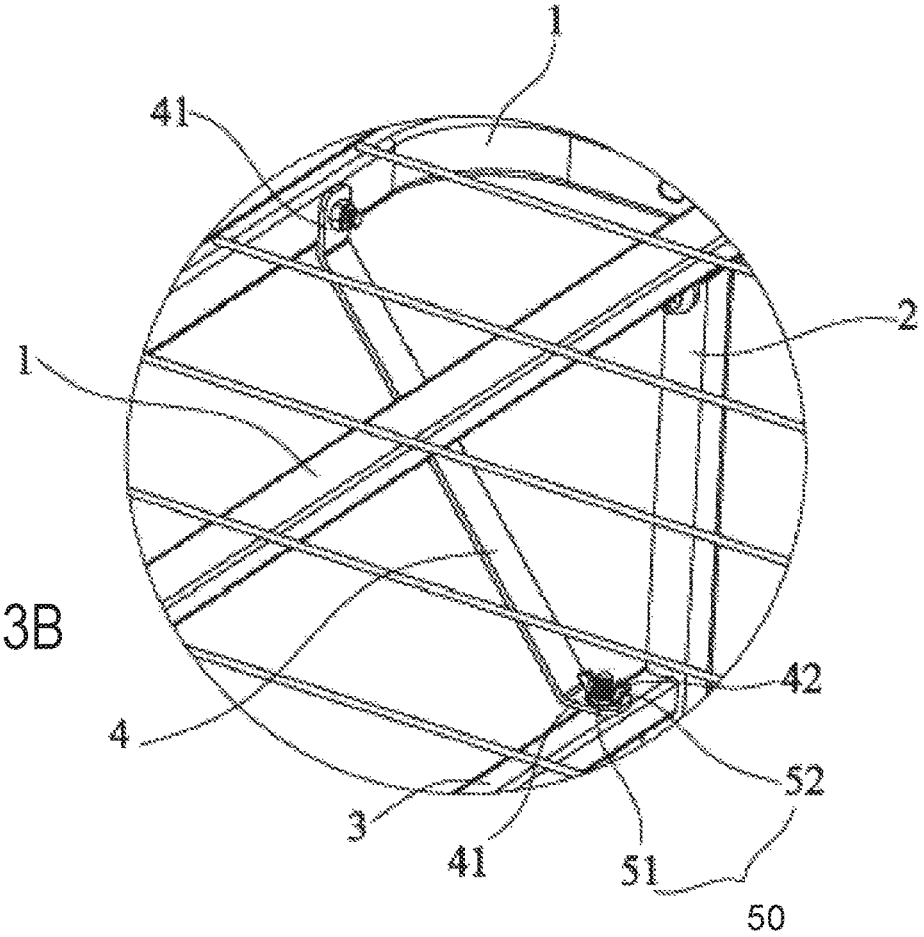
FIG. 13B is an enlarged schematic view taken along circle A in FIG. 13A.

In the embodiment illustrated in FIGS. 13A and 13B, one lug 41 of the oblique support is formed with a through hole, and the other lug 41 is formed with an open slot such as open slot 42. The lug with open slot 42 can be used to connect with the side leg assembly or with the sub-frame. By way of example, FIG. 13B illustrates the lug with open slot 42 connected to lateral bar 3 of leg assembly 20. Corresponding to the open slot of the oblique support, lateral bar 3 of leg assembly 20 is formed with an assembly hole for coupling with the oblique support. Corresponding to open slot 42, the foldable frame assembly includes a fastener such as fastener 50 for releasably and/or adjustably fastening the oblique support to the side leg assembly. Corresponding to the through hole of the oblique support, the peripheral lateral bar or portion of sub-frame 1 is formed with an assembly hole for coupling with the oblique support.

Figure 14A:
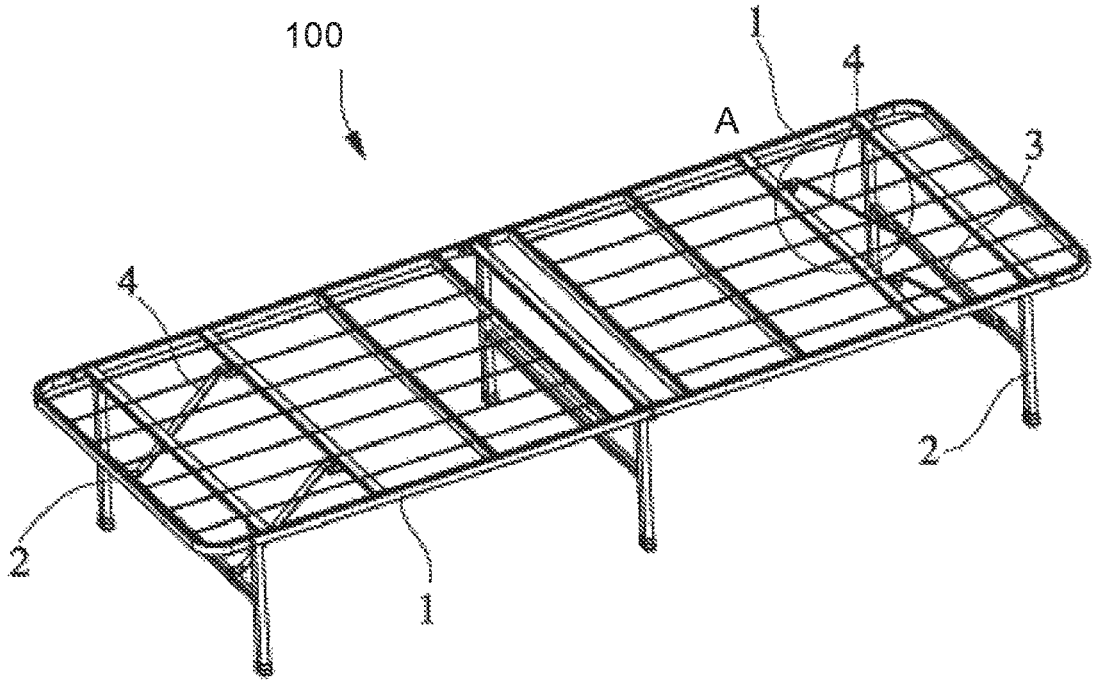
FIG. 14A is a schematic bottom perspective view illustrating the foldable bed frame of FIG. 13A with a variation of the fifth exemplary support.
Figure 14B:
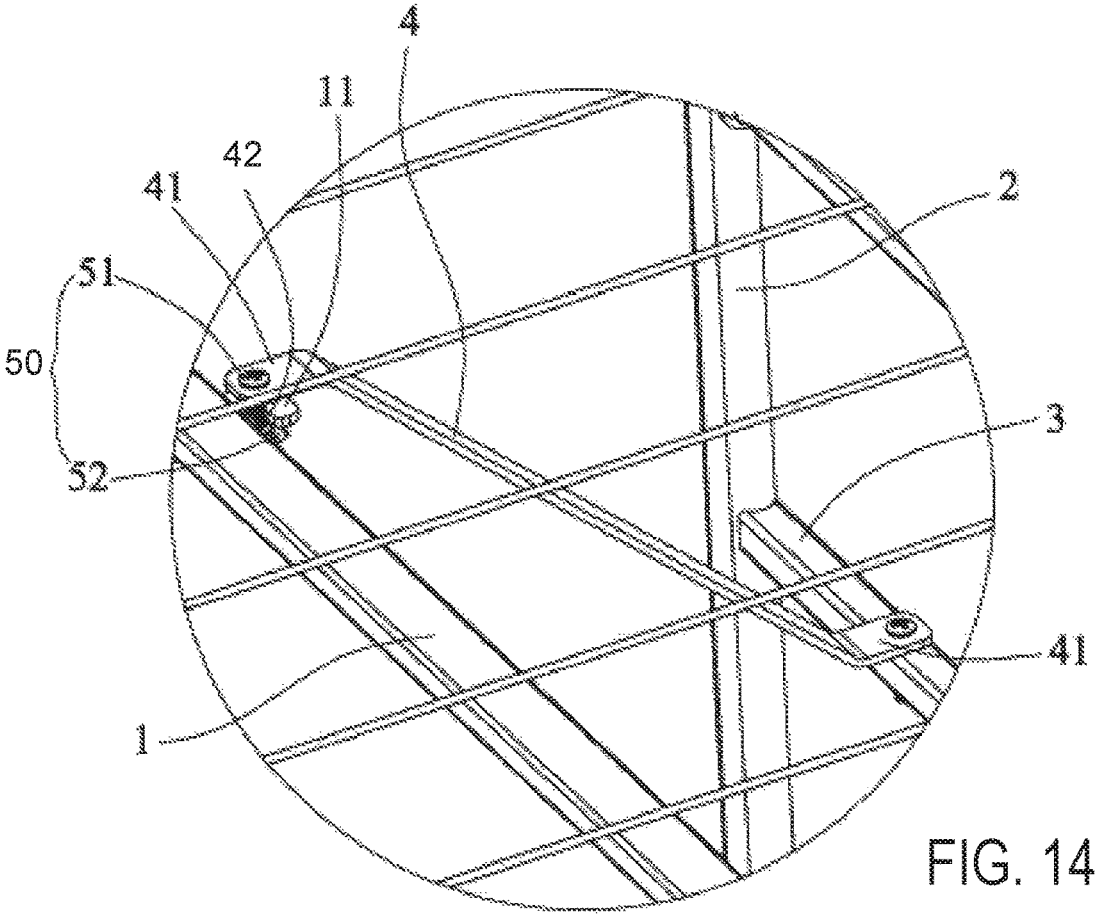
FIG. 14B is an enlarged schematic view taken along circle A in FIG. 14A.

In the embodiment illustrated in FIGS. 14A and 14B, each of the two lugs 41 is formed with a through hole. Corresponding to the oblique support, sub-frame 1 includes a connecting piece such as connecting piece 11 fixedly coupled to an interior lateral bar of sub-frame 1. Corresponding to the through holes of the oblique support, connecting piece 11 is formed with an open slot such as open slot 42 and lateral bar 3 of side leg assembly 20 is formed with an assembly hole for coupling with the oblique support. Open slot 42 can be of "U"-shape, "C"-shape or any other suitable shapes. Corresponding to open slot 42, the foldable frame assembly includes a fastener such as fastener 50 for releasably and/or adjustably fastening the oblique support to connecting piece 11 fixedly disposed on the interior bar of the sub-frame.

Figure 15A:
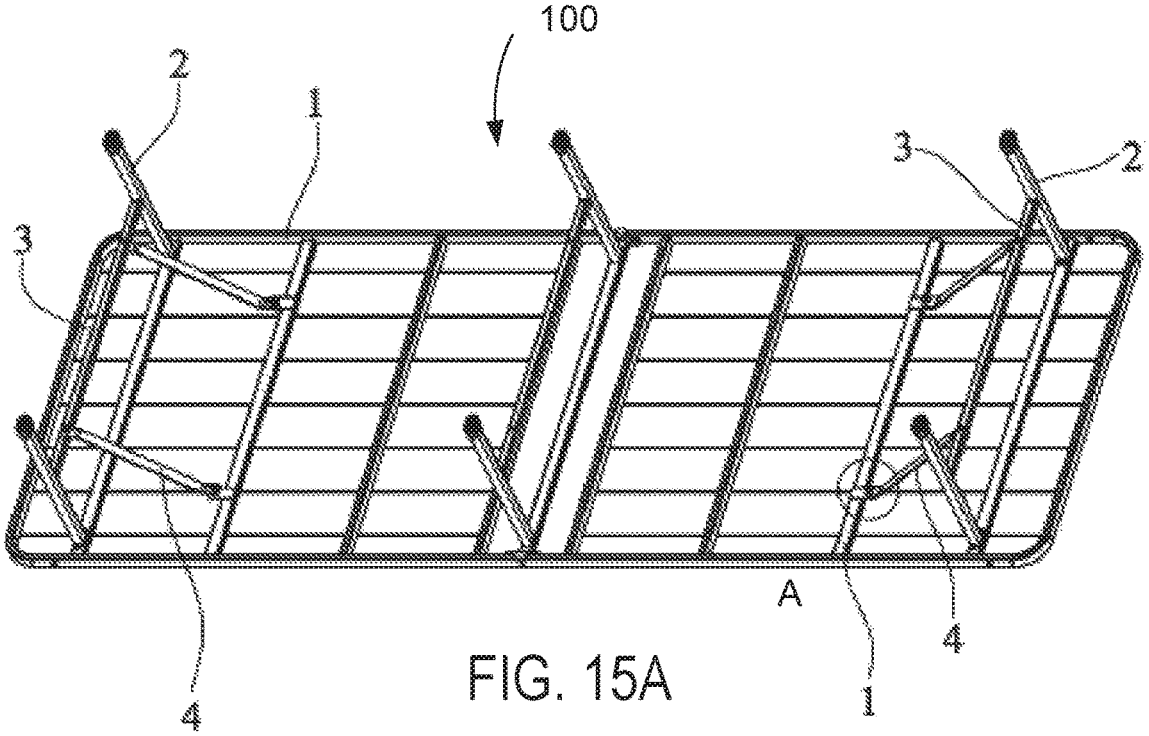
FIG. 15A is a schematic bottom perspective view illustrating the foldable bed frame of FIG. 13A with another variation of the fifth exemplary support.
Figure 15B:
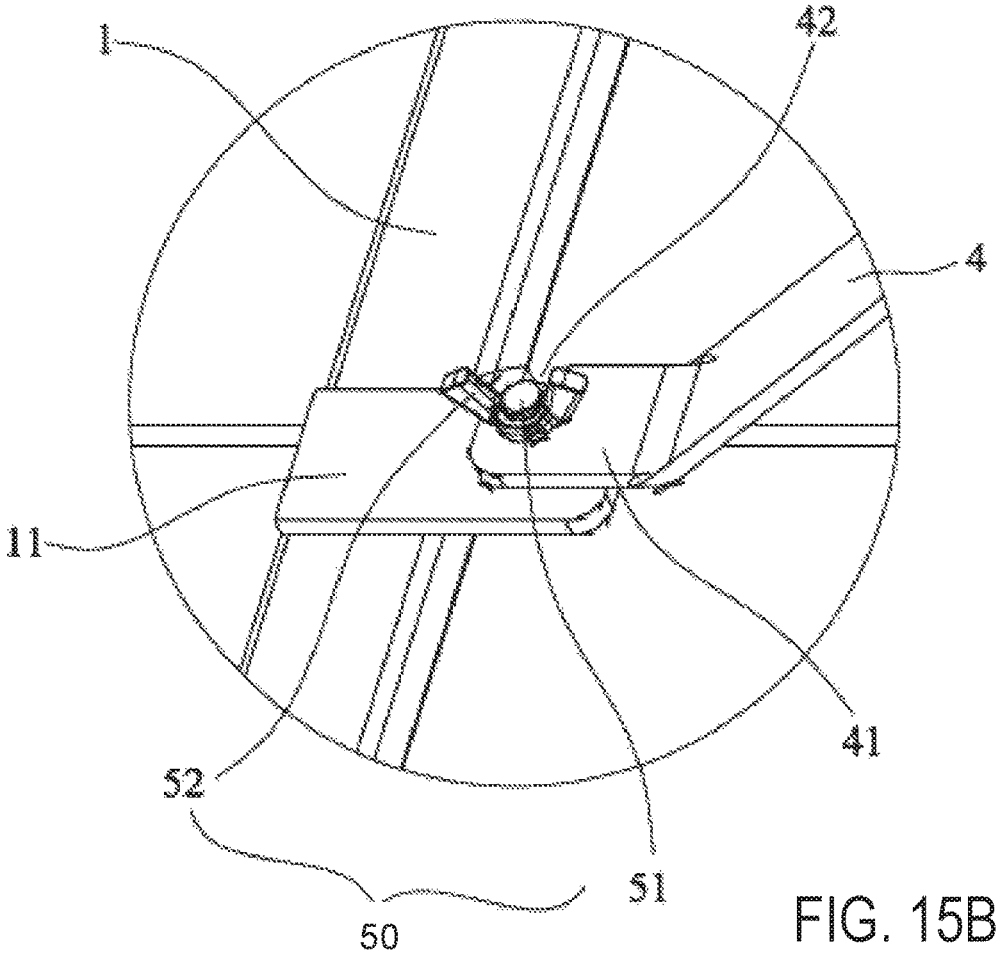
FIG. 15B is an enlarged schematic view taken along circle A in FIG. 15A.

In the embodiment illustrated in FIGS. 15A and 15B, one lug 41 of the oblique support is formed with a through hole, and the other lug 41 is formed with an open slot such as open slot 42. Corresponding to the through hole and the open slot of the oblique support, each of connecting piece 11 and the interior bar of sub-frame 1 is formed with an assembly hole for coupling with the oblique support. Corresponding to open slot 42, the foldable frame assembly includes a fastener such as fastener 50 for releasably and/or adjustably fastening the oblique support to connecting piece 11 fixedly disposed on the interior bar of the sub-frame.

Since one end of the oblique support is connected (e.g., fastened) to the lateral bar of the side leg assembly, and the other end of the oblique support is connected (e.g., fastened) to the sub-frame, the sub-frame, the side leg assembly and the oblique support(s) collectively form a triangular structure. As a result, the bed frame when unfolded is firm and stable. With the open slot (e.g., open slot 42), the bed frame is convenient to use. For example, to fold the bed frame, simply loosen fastener 50 first. Then, push or pull the oblique support sideways so that the fastener is released from the open slot (e.g., open slot 42), thereby disengaging the oblique support from the side leg assembly or the sub-frame. To unfold the bed frame, simply couple and then fasten the oblique support with the side leg assembly and the sub-frame through the corresponding assembly hole(s), through hole(s) and open slot(s). The open slot(s) allows fine adjustment in positioning the oblique support, making alignment easier before fastening the oblique support to the side leg assembly or the sub-frame. In addition, the opening slot, together with the fastener, eliminates or reduces the oppressing force the oblique support otherwise would act on the fastener, and/or on the assembly holes formed on the side leg assembly or the sub-frame, thereby preventing the fastener from loosening. As a result, vibration of the bed frame is eliminated or reduced, and the product lifetime is prolonged.

Referring to FIGS. 16A-16D, there depicts a foldable bed frame of the present invention with a sixth exemplary oblique support in accordance with some embodiments of the present invention. Like the second exemplary oblique support, the six exemplary oblique support has two ends, one connected to lateral bar 3 of leg assembly 20 and the other connected to sub-frame 1. Connection of the oblique surface to the side leg assembly and the sub-frame can be either directly or through connecting pieces.

In some embodiments, the sixth exemplary oblique support includes an inner tube such as inner tube 310, an outer tube such as outer tube 320, a locking mechanism, and an unlocking mechanism. Inner tube 310 and outer tube 320 are movably coupled to each other. Inner tube 310 is formed with at least one restriction hole such as first restriction hole 311, and outer tube 320 is formed with at least one restriction hole such as second restriction hole 321. When the first and second tubes are coupled, the first restriction hole of the inner tube and the second restriction hole of the second tube are corresponding to each other. In a preferred embodiment, the first restriction hole is formed at the distal end of the inner tube with respect to the outer tube, and the second restriction hole is formed at the proximal end of the outer tube with respect to the inner tube.

The locking mechanism is configured to restrict the movement of the inner and outer tubes with respect to each other. In some embodiments, the locking mechanism includes a positioning piece such as positioning piece 331. When the first and second restriction holes are aligned with each other, positioning piece 331 is inserted into the first and second restriction holes, thereby restricting the inner and outer tubes from moving with respect to each other. In some embodiments, the locking mechanism includes an elastic member such as elastic member 330 disposed inside of the inner tube, and a protrusion such as position piece 331 (e.g., the protrusion serving as the positioning piece) disposed at or formed with the elastic member. The protrusion is configured to selectively protrude out of the first and second restriction holes. In a preferred embodiment, the elastic member has a substantially "V" shape, and the protrusion is disposed at the outer side of the elastic member and adjacent the opening of the elastic member.

Figure 16A:
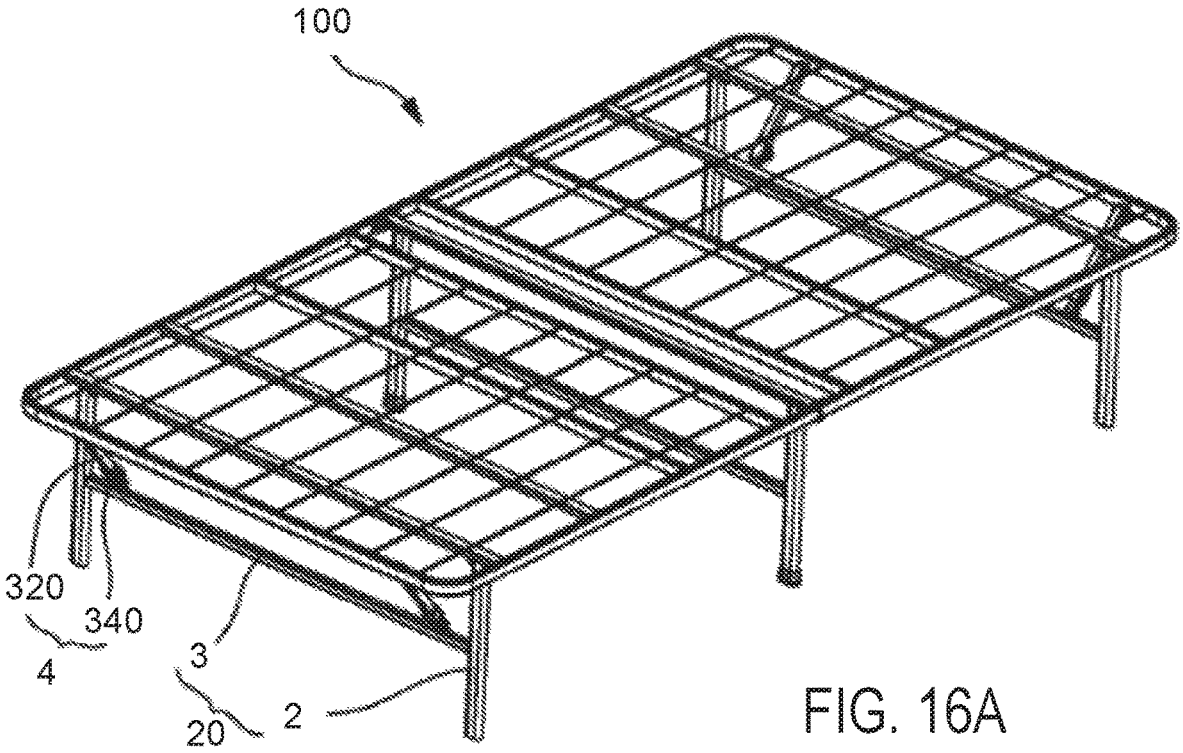
FIG. 16A is a schematic top perspective view illustrating a foldable bed frame in an unfolded state with a sixth exemplary support in accordance with exemplary embodiments of the present invention.
Figure 16B:
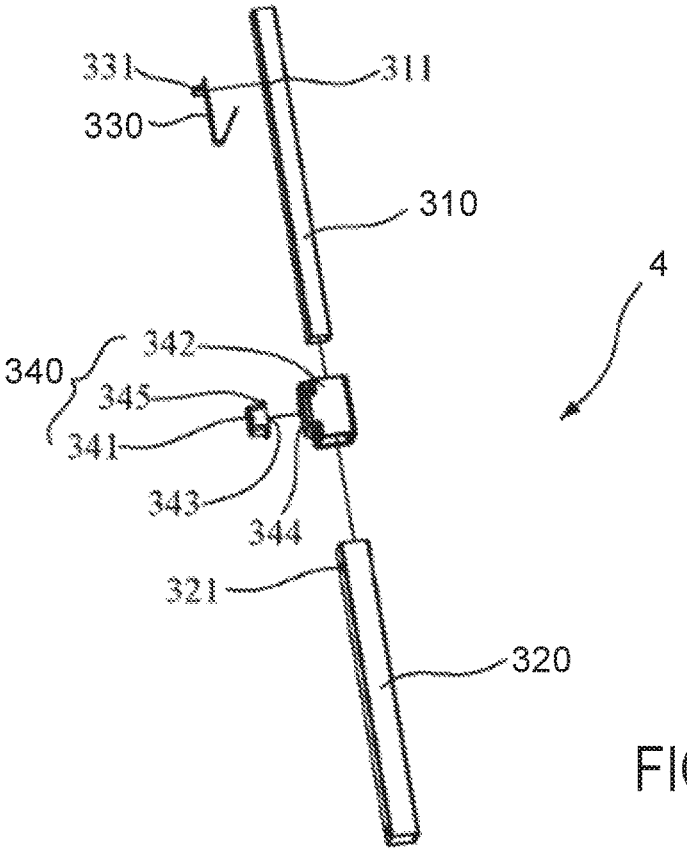
FIG. 16B is an exploded schematic view illustrating the sixth exemplary support in accordance with exemplary embodiments of the present invention.
Figure 16C:
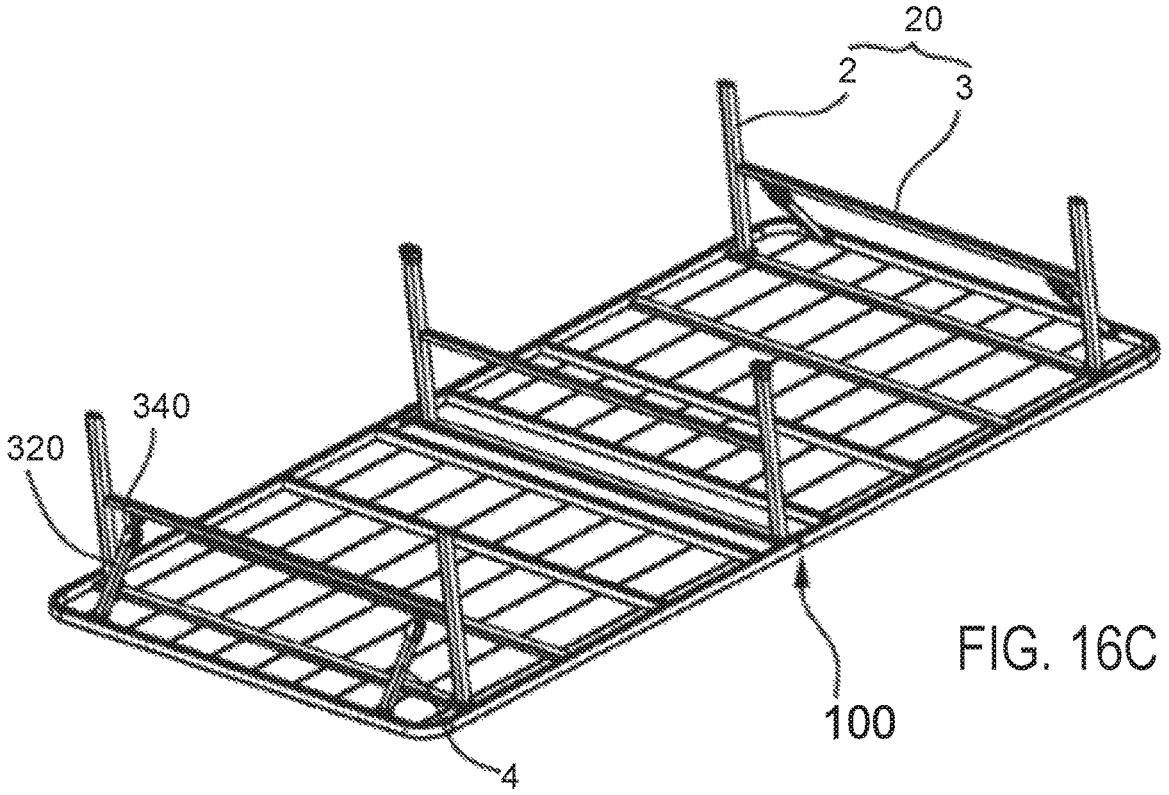
FIG. 16C is a schematic bottom perspective view illustrating the foldable bed frame of FIG. 16A.
Figure 16D:
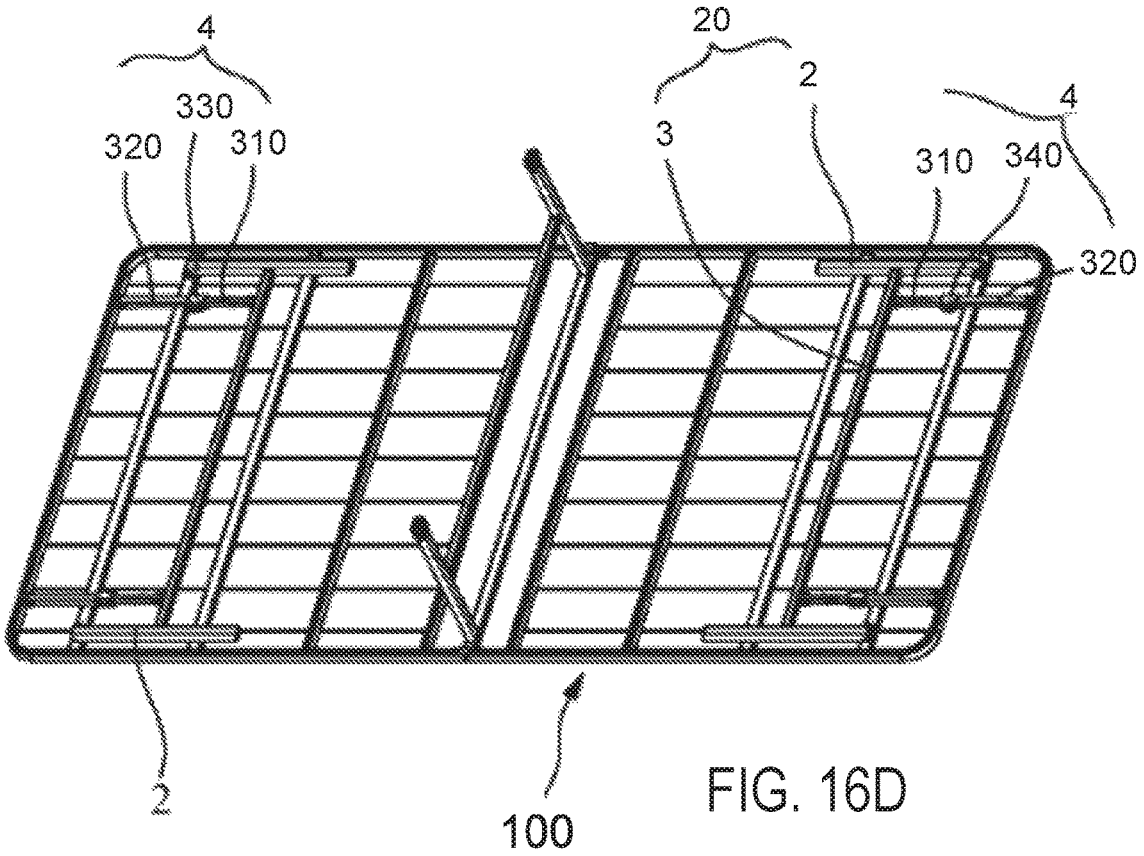
FIG. 16D is a schematic bottom perspective view illustrating the foldable bed frame of FIG. 16A in a partially folding state.
Figure 17A:
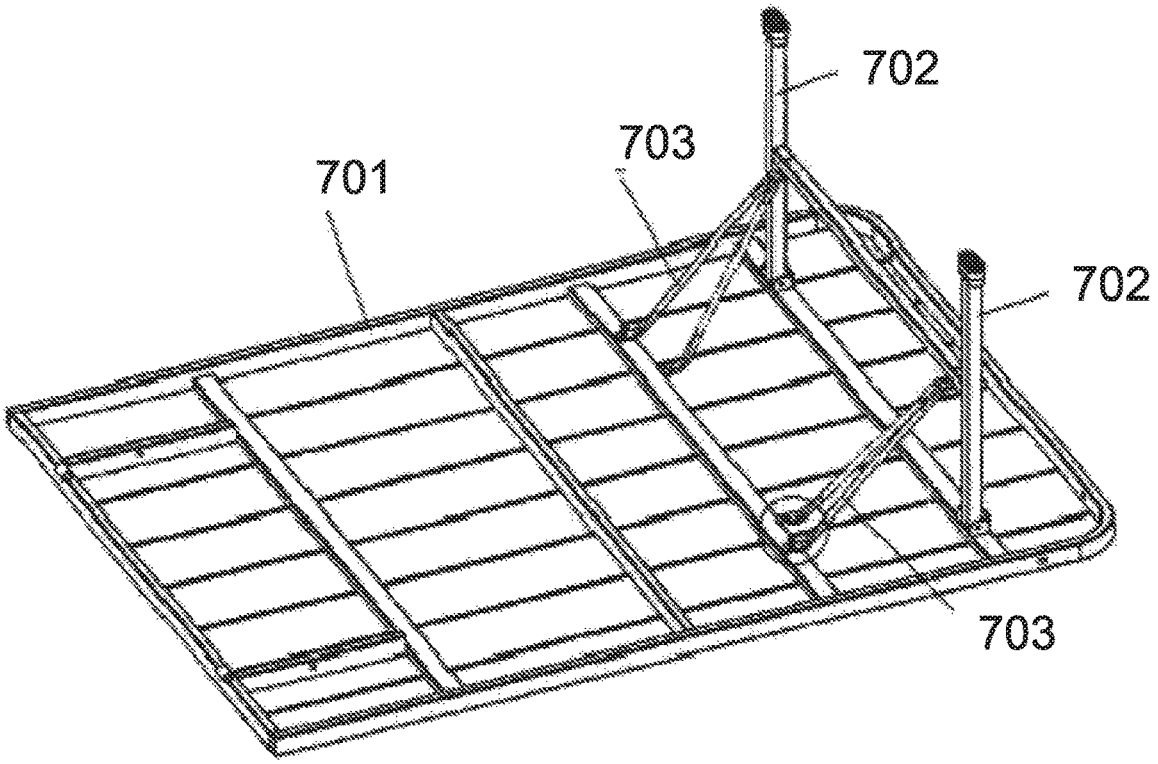
FIG. 17A (Related Art)
FIG. 17A illustrates a foldable bed frame of related art.
Figure 17B:
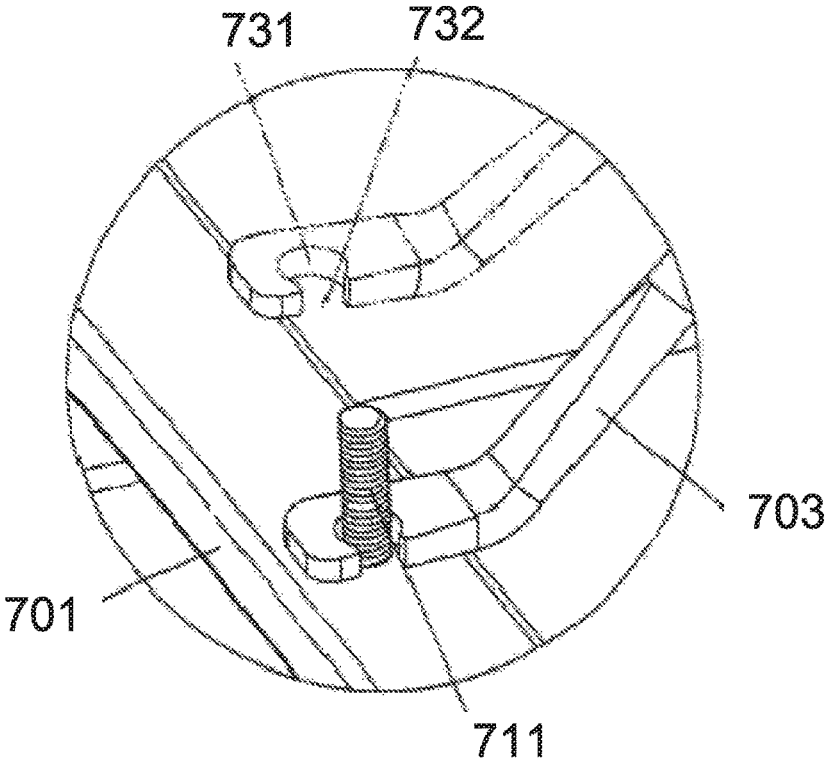
FIG. 17B (Related Art)
FIG. 17B is an enlarged view taken along the circle in FIG. 17A.

The unlocking mechanism is configured to unlock the locking mechanism and thus allow the inner and outer tubes to move with respect to each other. FIG. 16B illustrates unlocking mechanism 340 disposed at the outer tube and configured to disengage the positioning piece from the first or second restriction hole or from both of the first and second restriction holes. As shown, in some embodiments, unlocking mechanism 340 includes a sliding block such as sliding block 342 slidably disposed at the proximal end of outer tube 320. On a side corresponding to the second restriction hole of the outer tube, sliding block 342 is formed with an opening 344. Unlocking mechanism 340 also includes a push button such as push button 341 disposed at the sliding block for pushing or unlocking the positioning piece of the locking mechanism. In a preferred embodiment, push button 341 is formed with a pillar such as pillar 343 and one or more flanges such as flange 345. Pillar 343 is formed at the bottom of the push button and corresponding to the protrusion (e.g., positioning piece 331) of the locking mechanism. Flange 345 is formed on the sides or periphery of the push button and coupled with the inner side of the opening of the sliding block.

With movable inner and outer tubes, and locking and unlocking mechanisms, folding and unfolding the bed frame is simple and convenient. For example, to unfold the bed frame, rotate the side leg assembly away from the sub-frame. As one end of the oblique support is connected to the side leg assembly and the other end of the oblique support is connected to the sub-frame, rotating the side leg assembly causes the movement of the inner and outer tubes with respect to each other. When the side leg assembly is unfolded, the first and second restriction holes of the inner and outer tubes are aligned with each other. The protrusion (e.g., positioning piece 331) of the locking mechanism is inserted into the first and second restriction holes of the inner and outer tubes, and thus restricts the inner and outer tubes from further movements. At this state, the sub-frame, the side leg assembly and the oblique support(s) collectively form a triangular structure, making the unfolded bed frame firm and stable. To fold the side leg assembly or the bed frame, push the push button of the unlocking mechanism to disengage the positioning piece of the locking mechanism from the restriction hole of the outer tube or from the restriction holes of both the inner and outer tubes. Disengaging the position piece allows the inner and outer tubes to move with respect to each other and thus allows the side leg assembly to rotate toward and fold onto the sub-frame.

As the locking and unlocking mechanisms are disposed at the inner and outer tubes, potential loss of components is prevented. In addition, as the oblique support is connected to the sub-frame and the side leg assembly, spaces underneath of the bed frame are still usable, e.g., for storing household items.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "left" or "right", "longitudinal" or "lateral", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first sub-frame could be termed a second sub-frame, and, similarly, a second sub-frame could be termed a first sub-frame, without changing the meaning of the description, so long as all occurrences of the "first sub-frame" are renamed consistently and all occurrences of the "second sub-frame" are renamed consistently.

What is claimed is:

1. A foldable bed frame comprising:

first and second sub-frames pivotally connected to each other at proximal sides thereof, each sub-frame having a top surface and a bottom surface; and first and second side leg assemblies corresponding to the first and second sub-frames, wherein:

each of the first and second leg assemblies has a width less than a thickness of the corresponding sub-frame defined by a distance between the top and bottom surfaces of the sub-frame;

for each sub-frame, the side leg assembly is disposed at a distal side of the sub-frame, pivotally connected to the sub-frame, confined within a space between the top surface and the bottom surface of the sub-frame when folded, and supports the sub-frame when unfolded; and an overall thickness of the bed frame when folded is substantially the same as a sum of the thicknesses of the first and second sub-frames.

2. A foldable bed frame comprising:

first and second sub-frames pivotally connected to each other at proximal sides thereof, each sub-frame having a top surface and a bottom surface;

first and second side leg assemblies corresponding to the first and second sub-frames, wherein for each sub-frame, the side leg assembly is disposed at a distal side of the sub-frame, pivotally connected to the sub-frame, positioned within a space between the top surface and the bottom surface of the sub-frame when folded, and supports the sub-frame when unfolded; and a plurality of leg connecting pieces for pivotally connecting the side leg assemblies to the sub-frames, wherein each sub-frame comprises a peripheral frame having left and right longitudinal peripheral bars, and left and right interior longitudinal bars disposed within the peripheral frame and substantially parallel to the left and right longitudinal peripheral bars, respectively, and wherein each respective leg connecting piece is disposed between corresponding longitudinal peripheral and interior bars, pivotally connected to the corresponding longitudinal peripheral and interior bars, and fixedly connected to a corresponding side leg assembly.

3. The foldable bed frame of claim 2, wherein the leg connecting piece comprises a protrusion disposed in a leg of the side leg assembly.

4. The foldable bed frame of claim 2, the foldable bed frame further comprising:

a plurality of leg limiting pieces, each corresponding to a leg connecting piece and rotating along with the corresponding leg connecting piece.

5. The foldable bed frame of claim 2, the foldable bed frame further comprising:

a plurality of oblique supports, each having a first end connected to a corresponding sub-frame, and a second end connected to a corresponding side leg assembly.

6. The foldable bed frame of claim 5, wherein corresponding to each of the first and second sub-frames, the side leg assembly comprises:

a left leg pivotally connected to a left side of the sub-frame;

a right leg pivotally connected to a right side of the sub-frame; and a leg lateral bar connecting the left and right legs;

wherein the first end of a corresponding oblique support is connected to the left leg, the right leg or the lateral bar of the side leg assembly, and the second end of the corresponding oblique support is connected to a frame lateral bar of the sub-frame.

7. The foldable bed frame of claim 6, wherein the frame lateral bar is a peripheral lateral bar disposed at the proximal side of the sub-frame.

8. The foldable bed frame of claim 6, wherein the frame lateral bar is an interior lateral bar of the sub-frame.

9. The foldable bed frame of claim 6, wherein each of the first and second ends of an oblique support is formed with an assembly hole for coupling with the sub-frame and the side leg assembly.

10. The foldable bed frame of claim 6, wherein the first or second end of an oblique support is formed with an open slot for releasably or adjustably coupling with the sub-frame or the side leg assembly.

11. The foldable bed frame of claim 6, wherein corresponding to an oblique support, the side leg assembly further comprises a first connecting piece fixedly disposed at the left leg, the right leg or the leg lateral bar, wherein the first connecting piece is formed with an assembly hole or an opening slot for coupling with the first end of the oblique support.

12. The foldable bed frame of claim 6, wherein corresponding to an oblique support, the sub-frame further comprises a second connecting piece fixedly disposed at the frame lateral bar, wherein the second connecting piece is formed with an assembly hole or an opening slot for coupling with the second end of the oblique support.

13. The foldable bed frame of claim 6, wherein:

the first end of an oblique support in the plurality of oblique supports is fixedly or pivotally connected to the leg lateral bar of the side leg assembly; and the second end of the oblique support is releasably locked with the frame lateral bar of the sub-frame.

14. The foldable bed frame of claim 13, wherein the second end of the oblique support is releasably locked with the sub-frame by one of the following:

(i) the sub-frame is formed with an assembly hole, and the second end of the oblique support is formed with an opening slot corresponding to the assembly hole of the sub-frame, wherein the assembly hole of the sub-frame and the opening slot of the oblique support are coupled to each other by a fastener;

(ii) the sub-frame includes a connecting piece corresponding to the second end of the oblique support and formed with an assembly hole, and the second end of the oblique support is formed with an opening slot, wherein the assembly hole of the connecting piece and the opening slot of the oblique support are coupled to each other by a fastener; and (iii) the sub-frame includes a connecting piece corresponding to the second end of the oblique support and formed with an opening slot, and the second end of the oblique support is formed with an assembly hole, wherein the opening slot of the connecting piece and the assembly hole of the oblique support are coupled to each other by a fastener.

15. The foldable bed frame of claim 14, wherein the opening slot of the oblique support or the connecting piece has a "U" shape or a "C" shape.

16. The foldable bed frame of claim 6, wherein an oblique support in the plurality of oblique supports comprises:

an inner tube having a first restriction hole;

an outer tube movably coupled to the inner tube and having a second restriction hole corresponding to the first restriction hole of the inner tube;

a locking mechanism comprising a positioning piece configured to be inserted into the first and second restriction holes, thereby restricting the inner and outer tubes from moving with respect to each other; and an unlocking mechanism disposed at the outer tube and configured to release the positioning piece from one or more of the first and second restriction holes, thereby allowing the inner and outer tunes to move with respect to each other.

17. The foldable bed frame of claim 16, wherein:

the locking mechanism comprises an elastic member disposed inside of the inner tube, and a protrusion disposed at or formed with the elastic member, the protrusion serving as the positioning piece and configured to be selectively protruded out of the first and second restriction holes; and the unlocking mechanism comprises a sliding block and a push button disposed at the sliding block, the push button comprising a pillar corresponding to the protrusion of the locking mechanism.

18. The foldable bed frame of claim 17, wherein the elastic member has a substantially "V" shape, wherein the protrusion is disposed at an outer side of the elastic member and adjacent an opening of the elastic member.

19. The foldable bed frame of claim 16, wherein:

the first restriction hole is formed at a distal end of the inner tube with respect to the outer tube;

the second restriction hole is formed at a proximal end of the outer tube with respect to the inner tube;

the sliding block comprises an opening corresponding to the second restriction hole of the outer tube; and the push button is coupled to the opening of the sliding block by one or more flanges formed on one or more sides of the push button and coupled with an inner side of the opening of the sliding block.

20. The foldable bed frame of claim 6, the foldable bed frame further comprising a plurality of support connecting mechanisms, wherein:

the second end of an oblique support in the plurality oblique supports is formed with an assembly hole; and corresponding to the oblique support, a support connecting mechanism in the plurality of the support connecting mechanisms comprises:

a second connecting piece fixedly disposed at the frame lateral bar of a corresponding sub-frame, and formed with an assembly hole corresponding to the assembly hole formed at the second end of the oblique support;

a third connecting piece fixedly disposed at the frame lateral bar of the corresponding sub-frame, having a substantial "⊏" shape with two side segments and a middle segment connecting the two side segments, wherein each of the two side segments is formed with an assembly hole;

a fastener inserted into the assembly holes formed at the second end of the oblique support, at the second connecting piece and at the third connecting piece, thereby releasably coupling the oblique support with the sub-frame; and an elastic member disposed between the two side segments and coupled to the fastener to restore the fastener in an initial position.

21. The foldable bed frame of claim 20, wherein the fastener has a proximal end and a distal end with respect to the second connecting piece, wherein the support connecting mechanism further comprises a pull ring coupled to the distal end of the fastener.

22. The foldable bed frame of claim 20, wherein the elastic member sleeves on the fastener, and has one end coupled to the fastener and the other end coupled to the third connecting piece.

23. The foldable bed frame of claim 20, wherein the second and third connecting pieces are monolithically or integrally formed.

24. The foldable bed frame of claim 20, wherein the third connecting piece is fixedly disposed at the frame lateral bar of the corresponding sub-frame, with an opening of the third connecting piece facing the frame lateral bar.

25. The foldable bed frame of claim 20, wherein a proximal end of the fastener with respect to the second connecting piece is tapered or rounded to facilitate insertion of the fastener into the assembly holes formed at the second end of the oblique support, at the second connecting piece and at the third connecting piece.

26. The foldable bed frame of claim 2, wherein each side leg assembly comprises left and right legs and a leg lateral bar connecting the left and right legs.

27. The foldable bed frame of claim 2, further comprising a middle leg assembly disposed between the first and second sub-frames, and pivotally connected to the first and second sub-frames.

28. The foldable bed frame of claim 27, wherein the middle leg assembly comprises left and right middle legs, the foldable bed frame further comprising left and right frame connecting pieces, wherein each frame connecting piece is pivotally connected to a corresponding middle leg, and corresponding ends of the first and second sub-frames.

29. The foldable bed frame of claim 2, wherein each of the first and second leg assemblies has a width less than a thickness of the corresponding sub-frame defined by a distance between the top and bottom surface of the sub-frame.

30. A foldable bed frame comprising:

first and second sub-frames, each comprising two ends at a proximal side thereof, wherein a lower side of each end is formed with a recess;

a middle leg assembly disposed between the first and second sub-frames, and comprising left and right middle legs; and left and right frame connecting pieces, each pivotally connected to a corresponding middle leg, and each comprising a supporting segment and at least one connecting segment, wherein the supporting segment is formed at a lower portion of each frame connecting piece, wherein the connecting segment comprises a first side pivotally connected to a corresponding end of the first sub-frame, and a second side pivotally connected to a corresponding end of the second sub-frame, wherein when the foldable bed frame is folded, two ends of the supporting segments are positioned in the recesses formed at the lower sides of the corresponding ends of the first and second sub-frames, thereby minimizing a thickness of the foldable bed frame.

31. The foldable bed frame of claim 30, further comprising first and second side leg assemblies corresponding to the first and second sub-frames, wherein each side leg assembly is disposed at a distal side of the corresponding sub-frame and pivotally connected to the sub-frame.

32. The foldable bed frame of claim 31, further comprising a plurality of oblique supports, each having a first end connected to a corresponding sub-frame, and a second end connected to a corresponding side leg assembly.

33. The foldable bed frame of claim 30, wherein each frame connecting piece comprises two connecting segments substantially parallel to each other and connected to each other by the supporting segment.

34. The foldable bed frame of claim 30, wherein the connecting segment and the supporting segment of each frame connecting piece are monolithically or integrally formed as one piece.

35. The foldable bed frame of claim 30, wherein each sub-frame comprises a bent bar with two ends, and two bar connecting pieces, wherein each bar connecting piece comprises one or more first segments fixedly connected to a corresponding end of the bent bar, and a second segment pivotally connected to the corresponding frame connecting piece, wherein the recess is formed at a lower side of the second segment of the bar connecting piece.

36. The foldable bed frame of claim 35, wherein each bar connecting piece comprises two first segments, wherein the corresponding end of the bent bar is disposed in between the two first segments and fixedly coupled to the two first segments.

37. The foldable bed frame of claim 35, wherein the first and second segments of each bar connecting piece are monolithically or integrally formed as one piece.

38. The foldable bed frame of claim 35, wherein the bent bar has a substantial "⊏" shape.

* * * * *